US012222146B2

(12) United States Patent
Saeki et al.

(10) Patent No.: US 12,222,146 B2
(45) Date of Patent: Feb. 11, 2025

(54) CASCADE UNIT AND REFRIGERATION CYCLE APPARATUS

(71) Applicant: DAIKIN INDUSTRIES, LTD., Osaka (JP)

(72) Inventors: Kumiko Saeki, Osaka (JP); Yuta Iyoshi, Osaka (JP); Yoshiki Yamanoi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/621,426

(22) Filed: Mar. 29, 2024

(65) Prior Publication Data

US 2024/0240837 A1 Jul. 18, 2024

Related U.S. Application Data

(63) Continuation of application No. PCT/JP2022/035759, filed on Sep. 26, 2022.

(30) Foreign Application Priority Data

Sep. 30, 2021 (JP) ..... 2021-161996

(51) Int. Cl.
*F25B 7/00* (2006.01)
*F25B 9/00* (2006.01)

(52) U.S. Cl.
CPC ..... *F25B 7/00* (2013.01); *F25B 9/008* (2013.01); *F25B 2600/00* (2013.01)

(58) Field of Classification Search
CPC ..... F25B 7/00; F25B 9/008; F25B 2600/00; F25B 2700/19; F25B 2700/21
(Continued)

(56) References Cited

U.S. PATENT DOCUMENTS

2011/0120179 A1* 5/2011 Chin ..... F24D 17/02 62/512
2013/0298588 A1* 11/2013 Jojima ..... B60L 58/26 62/324.6
(Continued)

FOREIGN PATENT DOCUMENTS

EP 2 672 204 A1 12/2013
EP 3 812 662 A1 4/2021
(Continued)

OTHER PUBLICATIONS

English translation of the International Preliminary Report on Patentability and Written Opinion of the International Searching Authority for International Application No. PCT/JP2022/035759, dated Apr. 11, 2024.
(Continued)

*Primary Examiner* — Marc E Norman
(74) *Attorney, Agent, or Firm* — Birch, Stewart, Kolasch & Birch, LLP

(57) ABSTRACT

A cascade unit and a refrigeration cycle apparatus are capable of cooling an electric component. A cascade unit of a refrigeration cycle apparatus includes a primary-side refrigerant circuit that includes a primary-side heat exchanger and through which a primary-side refrigerant flows, a secondary-side refrigerant circuit that includes a secondary-side compressor and a utilization-side heat exchanger and through which a secondary-side refrigerant flows, and a cascade heat exchanger that exchanges heat between the primary-side refrigerant and the secondary-side refrigerant, the cascade unit including the secondary-side compressor, the cascade heat exchanger, a first electric component that drives the secondary-side compressor, a first cooling portion that cools the first electric component with the secondary-side refrigerant flowing through the secondary-side refrigerant circuit, a cascade casing that accommo-
(Continued)

dates the secondary-side compressor, the first electric component, and the first cooling portion.

10 Claims, 14 Drawing Sheets

(58) Field of Classification Search
USPC ..... 62/259.2
See application file for complete search history.

(56) References Cited

U.S. PATENT DOCUMENTS

| | | | | |
|---|---|---|---|---|
| 2021/0033302 | A1* | 2/2021 | Tsuji | F25B 13/00 |
| 2022/0186989 | A1 | 6/2022 | Yamaguchi et al. | |
| 2022/0325923 | A1* | 10/2022 | Yamada | F25B 7/00 |

FOREIGN PATENT DOCUMENTS

| | | | |
|---|---|---|---|
| JP | 2000-161794 | A | 6/2000 |
| JP | 2007-285544 | A | 11/2007 |
| JP | 2008-20083 | A | 1/2008 |
| JP | 2012-67962 | A | 4/2012 |
| JP | 2012-247136 | A | 12/2012 |
| JP | 2015-197281 | A | 11/2015 |
| JP | 2020-180709 | A | 11/2020 |
| WO | 2011-067905 | A1 | 6/2011 |
| WO | WO 2012/121326 | A1 | 9/2012 |
| WO | 2019-194013 | A1 | 10/2019 |
| WO | WO 2020/004108 | A1 | 1/2020 |
| WO | WO 2021/044547 | A1 | 3/2021 |

OTHER PUBLICATIONS

International Search Report (PCT/ISA/210) issued in PCT/JP2022/035759, dated Nov. 1, 2022.

Extended European Search Report dated Dec. 4, 2024 issued in European Application No. 22876140.9.

* cited by examiner

CASCADE UNIT AND REFRIGERATION CYCLE APPARATUS

CROSS REFERENCE TO RELATED APPLICATIONS

This application is a Continuation of PCT International Application No. PCT/JP2022/035759, filed on Sep. 26, 2022, which claims priority under 35 U.S.C. § 119(a) to Patent Application No. JP 2021-161996, filed in Japan on Sep. 30, 2021, all of which are hereby expressly incorporated by reference into the present application.

TECHNICAL FIELD

The present disclosure relates to a cascade unit and a refrigeration cycle apparatus.

BACKGROUND ART

Conventionally, an outdoor unit of a refrigeration cycle apparatus includes a compressor, an outdoor heat exchanger through which a refrigerant flows, a fan that supplies an air flow to the outdoor heat exchanger, an electric component box having an electric component for controlling a control target such as the compressor.

For example, in an outdoor unit described in Patent Literature 1 (JP 2020-180709 A), a heat sink for radiating heat is provided in an electric component box, and a part of an air flow by a fan sent to an outdoor heat exchanger is supplied to the heat sink to cool an electric component.

SUMMARY

A cascade unit according to a first aspect is a cascade unit of a refrigeration cycle apparatus. A refrigeration cycle apparatus includes a first circuit, a second circuit, and a cascade heat exchanger. A heat medium that conveys heat flows through the first circuit. The first circuit includes a first heat exchanger. The first heat exchanger causes a heat source and the heat medium to exchange heat with each other. The second circuit includes a compressor and a second heat exchanger that exchanges heat with indoor air. A refrigerant flows through the second circuit. The cascade heat exchanger exchanges heat between the heat medium flowing through the first circuit and the refrigerant flowing through the second circuit. The cascade unit includes a compressor, a cascade heat exchanger, an electric component, a cooling portion, and a cascade casing. The cooling portion cools the electric component by the refrigerant flowing through the second circuit. The cascade casing accommodates the compressor, the electric component, and the cooling portion.

DESCRIPTION OF EMBODIMENTS

(1) Configuration of Refrigeration Cycle Apparatus

Figure 1:
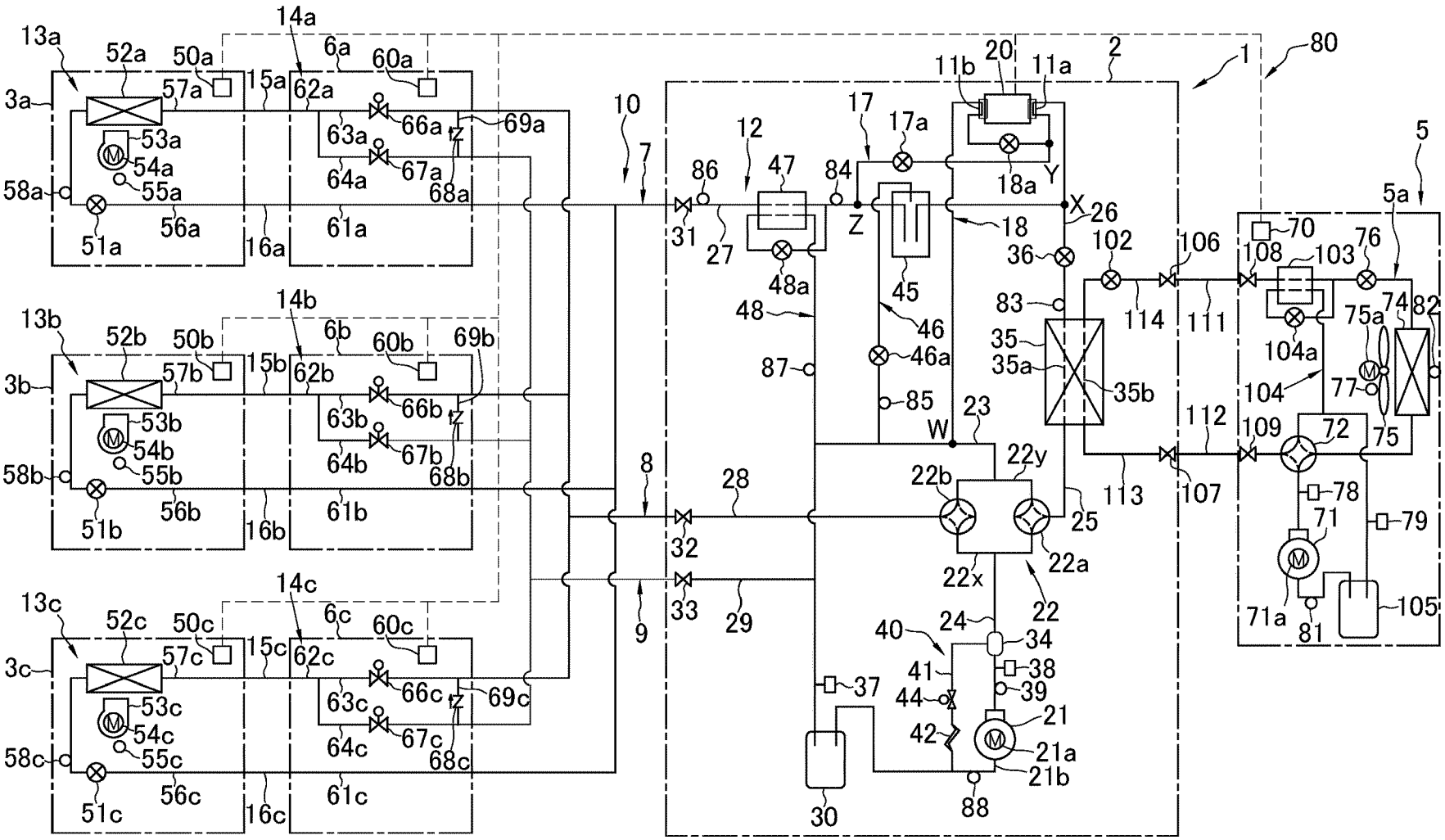
FIG. 1 is a schematic configuration diagram of a refrigeration cycle apparatus.
Figure 2:
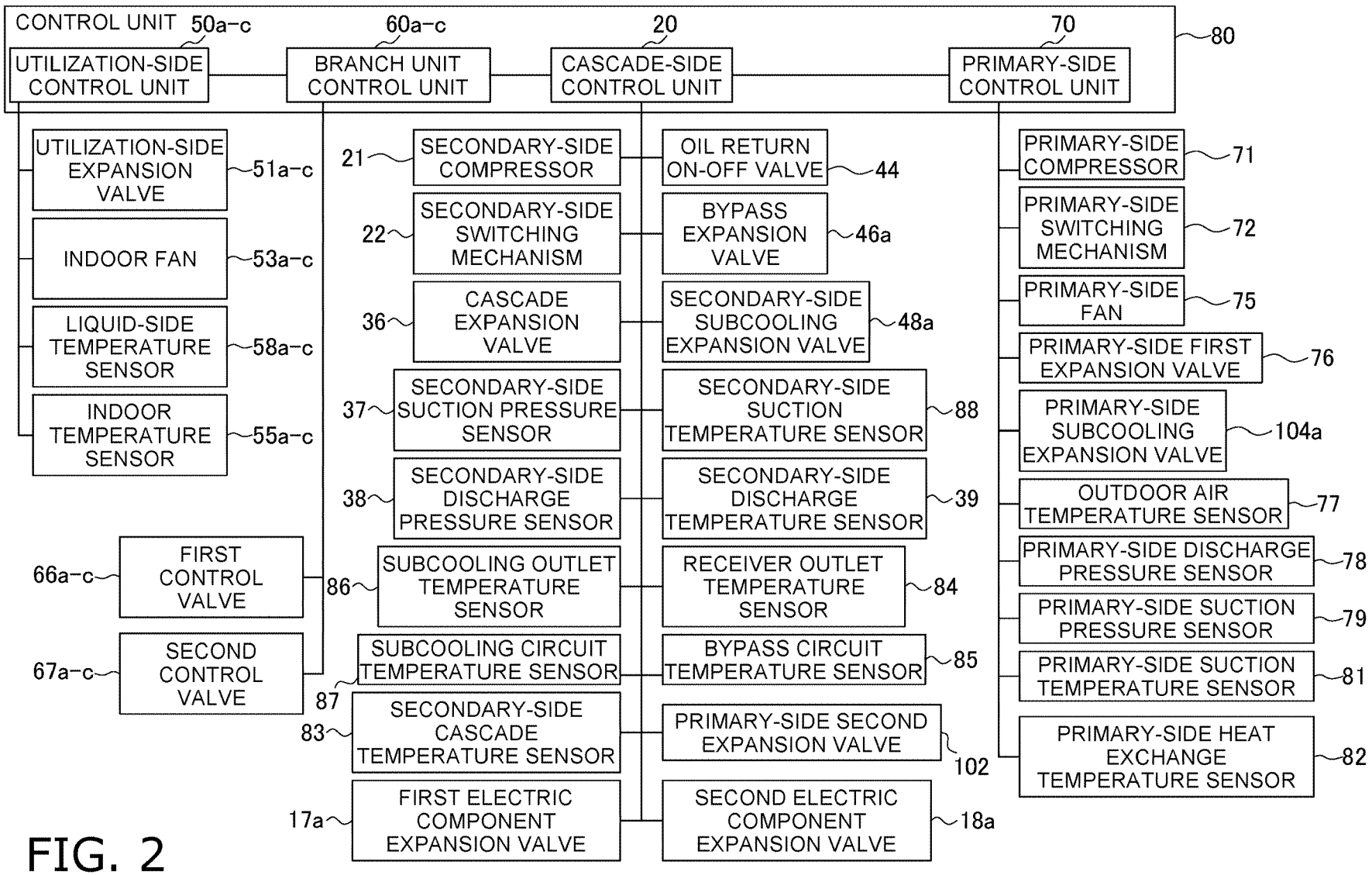
FIG. 2 is a schematic functional block configuration diagram of the refrigeration cycle apparatus.

FIG. 1 is a schematic configuration diagram of a refrigeration cycle apparatus 1. FIG. 2 is a schematic functional block configuration diagram of the refrigeration cycle apparatus 1.

The refrigeration cycle apparatus 1 is an apparatus used for cooling and heating a room in an office building or the like by performing a vapor compression refrigeration cycle operation.

The refrigeration cycle apparatus 1 includes a binary refrigerant circuit including a vapor compression primary-side refrigerant circuit 5*a* (corresponding to a first circuit) and a vapor compression secondary-side refrigerant circuit 10 (corresponding to a second circuit), and performs a binary refrigeration cycle. The primary-side refrigerant circuit 5*a* according to the present embodiment encloses, for example, R32, R410A (corresponding to a heat medium), or the like as a refrigerant. The secondary-side refrigerant circuit 10 encloses, for example, carbon dioxide (corresponding to a refrigerant) as a refrigerant. The primary-side refrigerant circuit 5*a* and the secondary-side refrigerant circuit 10 are thermally connected via a cascade heat exchanger 35 described later.

The refrigeration cycle apparatus 1 is configured by connecting a primary-side unit 5, a cascade unit 2, a plurality of branch units 6*a*, 6*b*, and 6*c*, and a plurality of utilization units 3*a*, 3*b*, and 3*c* to each other via pipes. The primary-side unit 5 and the cascade unit 2 are connected via a primary-side first connection pipe 111 and a primary-side second connection pipe 112. The cascade unit 2 and the plurality of branch units 6*a*, 6*b*, and 6*c* are connected via three connection pipes, namely, a secondary-side second connection pipe 9, a secondary-side first connection pipe 8, and a secondary-side third connection pipe 7. The plurality of branch units 6*a*, 6*b*, and 6*c* and the plurality of utilization units 3*a*, 3*b*, and 3*c* are connected via first connecting tubes 15*a*, 15*b*, and 15*c* and second connecting tubes 16*a*, 16*b*, and 16*c*. A single primary-side unit 5 is provided in the present embodiment. A single cascade unit 2 is provided in the present embodiment. The plurality of utilization units 3*a*, 3*b*, and 3*c* according to the present embodiment includes three utilization units, namely, a first utilization unit 3*a*, a second utilization unit 3*b*, and a third utilization unit 3*c*. The plurality of branch units 6*a*, 6*b*, and 6*c* according to the present embodiment includes three branch units, namely, a first branch unit 6*a*, a second branch unit 6*b*, and a third branch unit 6*c*.

In the refrigeration cycle apparatus 1, the utilization units 3*a*, 3*b*, and 3*c* can individually perform a cooling operation or a heating operation, and heat can be recovered between the utilization units by sending a refrigerant from the utilization unit performing the heating operation to the utilization unit performing the cooling operation. Specifically, heat is recovered in the present embodiment by executing a cooling main operation or a heating main operation of simultaneously executing the cooling operation and the heating operation. In addition, the refrigeration cycle apparatus 1 is configured to balance thermal loads of the cascade unit 2 in accordance with entire thermal loads of the plurality of utilization units 3*a*, 3*b*, and 3*c* in consideration of the heat recovery (the cooling main operation or the heating main operation).

(2) Primary-Side Refrigerant Circuit

The primary-side refrigerant circuit 5*a* includes a primary-side compressor 71 (corresponding to a first compressor), a primary-side switching mechanism 72, a primary-side heat exchanger 74 (corresponding to a first heat exchanger), a primary-side first expansion valve 76, a primary-side subcooling heat exchanger 103, a primary-side subcooling circuit 104, a primary-side subcooling expansion valve 104*a*, a first liquid shutoff valve 108, the primary-side first connection pipe 111, a second liquid shutoff valve 106, the second refrigerant pipe 114, a primary-side second expansion valve 102, the cascade heat exchanger 35 shared with the secondary-side refrigerant circuit 10, a first refrigerant pipe 113, a second gas shutoff valve 107, the primary-side second connection pipe 112, a first gas shutoff valve 109, and a primary-side accumulator 105. The primary-side refrigerant circuit 5*a* specifically includes a primary-side flow path 35*b* of the cascade heat exchanger 35.

The primary-side compressor 71 is configured to compress a primary-side refrigerant, and includes, for example, a scroll type or another positive-displacement compressor whose operating capacity can be varied by controlling an inverter for a compressor motor 71*a*.

The primary-side accumulator 105 is provided at a halfway portion of a suction flow path connecting the primary-side switching mechanism 72 and a suction side of the primary-side compressor 71.

In a case where the cascade heat exchanger 35 functions as an evaporator for the primary-side refrigerant, the primary-side switching mechanism 72 enters a fifth connecting state of connecting the suction side of the primary-side compressor 71 and a gas side of the primary-side flow path 35*b* of the cascade heat exchanger 35 (see the solid lines of the primary-side switching mechanism 72 in FIG. 1). In another case where the cascade heat exchanger 35 functions as a radiator for the primary-side refrigerant, the primary-side switching mechanism 72 enters a sixth connecting state of connecting a discharge side of the primary-side compressor 71 and the gas side of the primary-side flow path 35*b* of the cascade heat exchanger 35 (see broken lines of the primary-side switching mechanism 72 in FIG. 1). The primary-side switching mechanism 72 is a device that can switch the flow paths of the refrigerant in the primary-side refrigerant circuit 5*a*, and includes, for example, a four-way switching valve. By changing a switching state of the primary-side switching mechanism 72, the cascade heat exchanger 35 can function as the evaporator or the radiator for the primary-side refrigerant.

The cascade heat exchanger 35 is configured to cause heat exchange between the primary-side refrigerant such as R32 and a secondary-side refrigerant such as carbon dioxide without mixing the refrigerants. The cascade heat exchanger 35 includes, for example, a plate heat exchanger. The cascade heat exchanger 35 includes a secondary-side flow path 35*a* belonging to the secondary-side refrigerant circuit 10, and the primary-side flow path 35*b* belonging to the primary-side refrigerant circuit 5*a*. The secondary-side flow path 35*a* has a gas side connected to a secondary-side switching mechanism 22 via a third pipe 25, and a liquid side connected to a cascade expansion valve 36 via a fourth pipe 26. The primary-side flow path 35*b* has a gas side connected to the primary-side compressor 71 via the first refrigerant pipe 113, the second gas shutoff valve 107, the primary-side second connection pipe 112, the first gas shutoff valve 109, and the primary-side switching mechanism 72, and a liquid side connected to the second refrigerant pipe 114 provided with the primary-side second expansion valve 102.

The primary-side heat exchanger 74 is configured to exchange heat between the primary-side refrigerant and outdoor air. The primary-side heat exchanger 74 has a gas side connected to a pipe extending from the primary-side switching mechanism 72. Examples of the primary-side heat exchanger 74 include a fin-and-tube heat exchanger constituted by large numbers of heat transfer tubes and fins.

The primary-side first expansion valve 76 is provided on a liquid pipe extending from a liquid side of the primary-side heat exchanger 74 to the primary-side subcooling heat exchanger 103. The primary-side first expansion valve 76 is an electrically powered expansion valve that has an adjustable opening degree and adjusts a flow rate of the primary-side refrigerant flowing in a portion on a liquid side of the primary-side refrigerant circuit 5*a*.

The primary-side subcooling circuit 104 branches from a portion between the primary-side first expansion valve 76 and the primary-side subcooling heat exchanger 103, and is connected to a portion between the primary-side switching mechanism 72 and the primary-side accumulator 105 on the suction flow path. The primary-side subcooling expansion valve 104*a* is an electrically powered expansion valve that is provided upstream of the primary-side subcooling heat exchanger 103 in the primary-side subcooling circuit 104, has an adjustable opening degree, and adjusts the flow rate of the primary-side refrigerant.

The primary-side subcooling heat exchanger 103 is a heat exchanger that causes heat exchange between a refrigerant flowing from the primary-side first expansion valve 76 toward the first liquid shutoff valve 108 and a refrigerant decompressed at the primary-side subcooling expansion valve 104*a* in the primary-side subcooling circuit 104.

The primary-side first connection pipe 111 is a pipe connecting the first liquid shutoff valve 108 and the second liquid shutoff valve 106, and connects the primary-side unit 5 and the cascade unit 2.

The primary-side second connection pipe 112 is a pipe connecting the first gas shutoff valve 109 and the second gas shutoff valve 107, and connects the primary-side unit 5 and the cascade unit 2.

The second refrigerant pipe 114 is a pipe extending from the liquid side of the primary-side flow path 35*b* of the cascade heat exchanger 35 to the second liquid shutoff valve 106.

The primary-side second expansion valve 102 is provided on the second refrigerant pipe 114. The primary-side second expansion valve 102 is an electric expansion valve that has an adjustable opening degree and adjusts the flow rate of the primary-side refrigerant flowing through the primary-side flow path 35*b* of the cascade heat exchanger 35.

The first refrigerant pipe 113 is a pipe extending from the gas side of the primary-side flow path 35*b* of the cascade heat exchanger 35 to the second gas shutoff valve 107.

The first gas shutoff valve 109 is provided at a portion between the primary-side second connection pipe 112 and the primary-side switching mechanism 72.

(3) Secondary-Side Refrigerant Circuit

The secondary-side refrigerant circuit 10 includes the plurality of utilization units 3*a*, 3*b*, and 3*c*, the plurality of branch units 6*a*, 6*b*, and 6*c*, and the cascade unit 2, which are connected to each other. Each of the utilization units 3*a*, 3*b*, and 3*c* is connected to a corresponding one of the branch units 6*a*, 6*b*, and 6*c* on one-on-one basis. Specifically, the utilization unit 3*a* and the branch unit 6*a* are connected via the first connecting tube 15*a* and the second connecting tube 16*a*, the utilization unit 3*b* and the branch unit 6*b* are connected via the first connecting tube 15*b* and the second connecting tube 16*b*, and the utilization unit 3*c* and the branch unit 6*c* are connected via the first connecting tube 15*c* and the second connecting tube 16*c*. Each of the branch units 6*a*, 6*b*, and 6*c* are connected to the cascade unit 2 via three connection pipes, namely, the secondary-side third connection pipe 7, the secondary-side first connection pipe 8, and the secondary-side second connection pipe 9. Specifically, the secondary-side third connection pipe 7, the secondary-side first connection pipe 8, and the secondary-side second connection pipe 9 extending from the cascade unit 2 are each branched into a plurality of pipes connected to the branch units 6*a*, 6*b*, and 6*c*.

The secondary-side first connection pipe 8 has a flow of either the refrigerant in a gas-liquid two-phase state or the refrigerant in a gas state in accordance with an operating state. Note that the secondary-side first connection pipe 8 has a flow of the refrigerant in a supercritical state in accordance with the operating state. The secondary-side second connection pipe 9 has a flow of either the refrigerant in the gas-liquid two-phase state or the refrigerant in the gas state in accordance with the operating state. The secondary-side third connection pipe 7 has a flow of either the refrigerant in the gas-liquid two-phase state or the refrigerant in a liquid state in accordance with the operating state. Note that the secondary-side third connection pipe 7 has a flow of the refrigerant in the supercritical state in accordance with the operating state.

The secondary-side refrigerant circuit 10 includes a cascade circuit 12, branch circuits 14*a*, 14*b*, and 14*c*, and utilization circuits 13*a*, 13*b*, and 13*c*, which are connected to each other.

The cascade circuit 12 mainly includes a secondary-side compressor 21 (corresponding to a compressor), the secondary-side switching mechanism 22, a first pipe 28, a second pipe 29, a suction flow path 23, a discharge flow path 24, the third pipe 25, the fourth pipe 26, a fifth pipe 27, the cascade heat exchanger 35, the cascade expansion valve 36, a first electric component cooling flow path 17, a second electric component cooling flow path 18, a third shutoff valve 31, a first shutoff valve 32, a second shutoff valve 33, a secondary-side accumulator 30, an oil separator 34, an oil return circuit 40, a secondary-side receiver 45, a bypass circuit 46, a bypass expansion valve 46*a*, a secondary-side subcooling heat exchanger 47, a secondary-side subcooling circuit 48, and a secondary-side subcooling expansion valve 48*a*. The cascade circuit 12 of the secondary-side refrigerant circuit 10 specifically includes the secondary-side flow path 35*a* of the cascade heat exchanger 35.

The secondary-side compressor 21 is configured to compress a secondary-side refrigerant, and includes, for example, a scroll type or other positive-displacement compressor whose operating capacity can be varied by controlling an inverter for a compressor motor 21*a*. The secondary-side compressor 21 is controlled in accordance with an operating load so as to have larger operating capacity as the load increases.

The secondary-side switching mechanism 22 can switch a connecting state of the secondary-side refrigerant circuit 10, specifically, the flow path of the refrigerant in the cascade circuit 12. The secondary-side switching mechanism 22 according to the present embodiment includes a discharge-side connection portion 22*x*, a suction-side connection portion 22*y*, a first switching valve 22*a*, and a second switching valve 22*b*. An end of the discharge flow path 24 on a side opposite to the secondary-side compressor 21 is connected to the discharge-side connection portion 22*x*. An end of the suction flow path 23 on a side opposite to the secondary-side compressor 21 is connected to the suction-side connection portion 22*y*. The first switching valve 22*a* and the second switching valve 22*b* are provided in parallel to each other between the discharge flow path 24 and the suction flow path 23 of the secondary-side compressor 21. The first switching valve 22*a* is connected to one end of the discharge-side connection portion 22*x* and one end of the suction-side connection portion 22*y*. The second switching valve 22*b* is connected to the other end of the discharge-side connection portion 22*x* and the other end of the suction-side connection portion 22*y*. In the present embodiment, each of the first switching valve 22*a* and the second switching valve 22*b* includes the four-way switching valve. Each of the first switching valve 22*a* and the second switching valve 22*b* has four connection ports, namely, a first connection port, a second connection port, a third connection port, and a fourth connection port. In the first switching valve 22*a* and the second switching valve 22*b* according to the present embodiment, each of the fourth ports is closed and is a connection port not connected to the flow path of the secondary-side refrigerant circuit 10. In the first switching valve 22*a*, the first connection port is connected to the one end of the discharge-side connection portion 22*x*, the second connection port is connected to the third pipe 25 extending from the secondary-side flow path 35*a* of the cascade heat exchanger 35, and the third connection port is connected to the one end of the suction-side connection portion 22*y*. The first switching valve 22*a* switches between a switching state in which the first connection port and the second connection port are connected and the third connection port and the fourth connection port are connected and a switching state in which the third connection port and the second connection port are connected and the first connection port and the fourth connection port are connected. The second switching valve 22*b* has the first connection port connected to the other end of the discharge-side connection portion 22*x*, the second connection port connected to the first pipe 28, and the third connection port connected to the other end of the suction-side connection portion 22*y*. The second switching valve 22*b* switches between a switching state in which the first connection port and the second connection port are connected and the third connection port and the fourth connection port are connected and a switching state in which the third connection port and the second connection port are connected and the first connection port and the fourth connection port are connected.

When the secondary-side refrigerant discharged from the secondary-side compressor 21 is prevented from being sent to the secondary-side first connection pipe 8 while the cascade heat exchanger 35 functions as a radiator for the secondary-side refrigerant, the secondary-side switching mechanism 22 is switched to a first connecting state in which the discharge flow path 24 and the third pipe 25 are connected by the first switching valve 22*a* and the first pipe 28 and the suction flow path 23 are connected by the second switching valve 22*b*. The first connecting state of the secondary-side switching mechanism 22 is a connecting state adopted during the cooling operation described later. When the cascade heat exchanger 35 functions as an evaporator for the secondary-side refrigerant, the secondary-side switching mechanism 22 is switched to a second connecting state in which the discharge flow path 24 and the first pipe 28 are connected by the second switching valve 22*b* and the third pipe 25 and the suction flow path 23 are connected by the first switching valve 22*a*. The second connecting state of the secondary-side switching mechanism 22 is a connecting state adopted during the heating operation and during the heating main operation described later. When the secondary-side refrigerant discharged from the secondary-side compressor 21 is sent to the secondary-side first connection pipe 8 while the cascade heat exchanger 35 functions as a radiator for the secondary-side refrigerant, the secondary-side switching mechanism 22 is switched to a third connecting state in which the discharge flow path 24 and the third pipe 25 are connected by the first switching valve 22*a* and the discharge flow path 24 and the first pipe 28 are connected by the second switching valve 22*b*. The third connecting state of the secondary-side switching mechanism 22 is a connecting state adopted during the cooling main operation described later.

Figure 7:
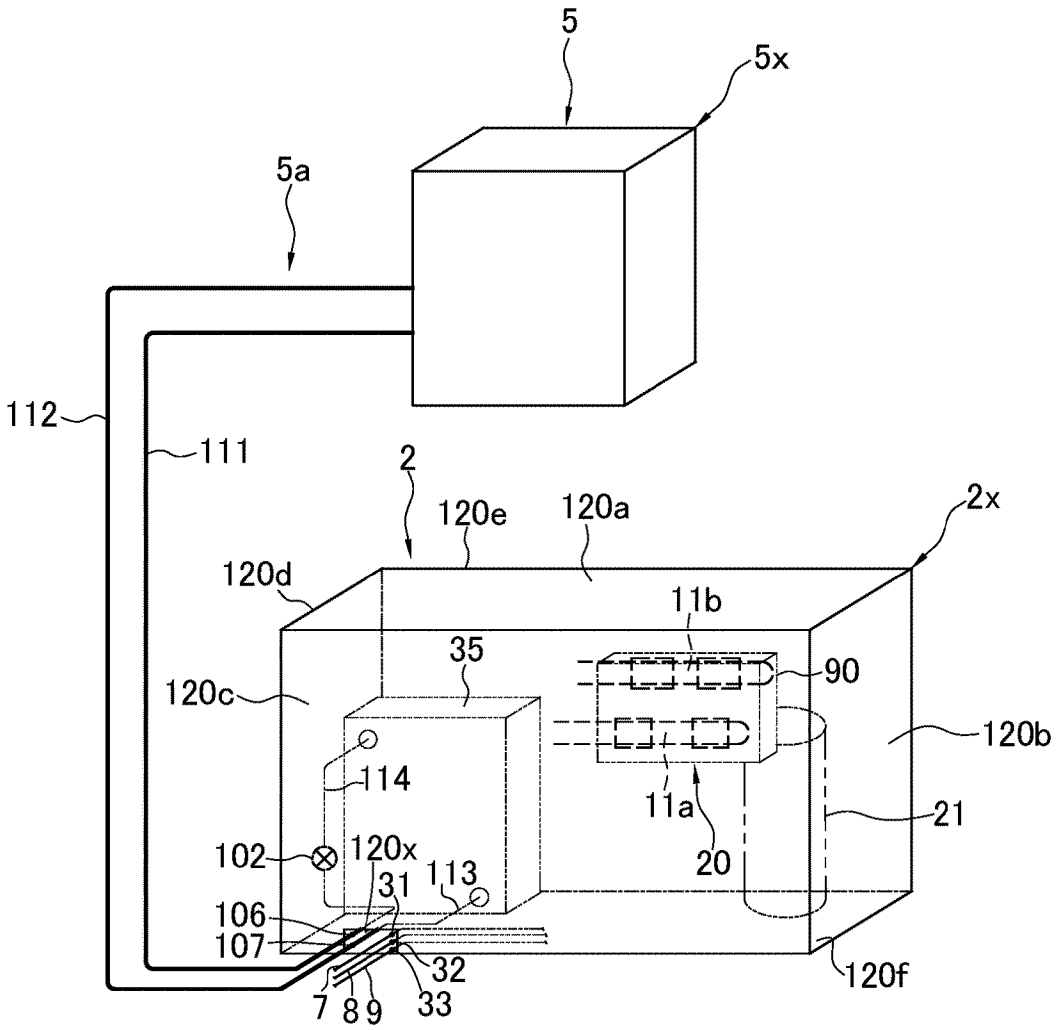
FIG. 7 is a schematic diagram illustrating connection between a primary-side unit and a cascade unit.

As described above, the cascade heat exchanger 35 is configured to cause heat exchange between the primary-side refrigerant such as R32 and the secondary-side refrigerant such as carbon dioxide without mixing the refrigerants. The cascade heat exchanger 35 includes the secondary-side flow path 35*a* having a flow of the secondary-side refrigerant in the secondary-side refrigerant circuit 10 and the primary-side flow path 35*b* having a flow of the primary-side refrigerant in the primary-side refrigerant circuit 5*a*, so as to be shared between the primary-side unit 5 and the cascade unit 2. Note that in the present embodiment, as shown in FIG. 7, the cascade heat exchanger 35 is disposed inside a cascade casing 2*x* of the cascade unit 2. The gas side of the primary-side flow path 35*b* of the cascade heat exchanger 35 extends to the primary-side second connection pipe 112 outside the cascade casing 2*x* via the first refrigerant pipe 113 and the second gas shutoff valve 107. The liquid side of the primary-side flow path 35*b* of the cascade heat exchanger 35 extends to the primary-side first connection pipe 111 outside the cascade casing 2*x* via the second refrigerant pipe 114 provided with the primary-side second expansion valve 102 and the second liquid shutoff valve 106.

The cascade expansion valve 36 is an expansion valve for adjusting a flow rate of the secondary-side refrigerant flowing in the cascade heat exchanger 35. The cascade expansion valve 36 is an electric expansion valve connected to the liquid side of the cascade heat exchanger 35 and has an adjustable opening degree. The cascade expansion valve 36 is provided on the fourth pipe 26.

Each of the third shutoff valve 31, the first shutoff valve 32, and the second shutoff valve 33 is provided at a connecting port with an external device or pipe (specifically, the connection pipe 7, 8, or 9). Specifically, the third shutoff valve 31 is connected to the secondary-side third connection pipe 7 led out of the cascade unit 2. The first shutoff valve 32 is connected to the secondary-side first connection pipe 8 led out of the cascade unit 2. The second shutoff valve 33 is connected to the secondary-side second connection pipe 9 led out of the cascade unit 2.

The first pipe 28 is a refrigerant pipe that connects the first shutoff valve 32 and the secondary-side switching mechanism 22. Specifically, the first pipe 28 connects the first shutoff valve 32 and the second connection port of the second switching valve 22*b* of the secondary-side switching mechanism 22.

The suction flow path 23 is a flow path that connects the secondary-side switching mechanism 22 and the suction side of the secondary-side compressor 21. Specifically, the suction flow path 23 connects the suction-side connection portion 22*y* of the secondary-side switching mechanism 22 and the suction side of the secondary-side compressor 21. The suction flow path 23 has a halfway portion provided with the secondary-side accumulator 30.

The second pipe 29 is a refrigerant pipe that connects the second shutoff valve 33 and a halfway portion of the suction flow path 23. In the present embodiment, the second pipe 29 is connected to the suction flow path 23 at a connection point of the suction flow path 23 between the suction-side connection portion 22*y* of the secondary-side switching mechanism 22 and the secondary-side accumulator 30.

The discharge flow path 24 is a refrigerant pipe that connects the discharge side of the secondary-side compressor 21 and the secondary-side switching mechanism 22. Specifically, the discharge flow path 24 connects the discharge side of the secondary-side compressor 21 and the discharge-side connection portion 22*x* of the secondary-side switching mechanism 22.

The third pipe 25 is a refrigerant pipe that connects the secondary-side switching mechanism 22 and a gas side of the cascade heat exchanger 35. Specifically, the third pipe 25 connects the second connection port of the first switching valve 22*a* of the secondary-side switching mechanism 22 and a gas-side end of the secondary-side flow path 35*a* in the cascade heat exchanger 35.

The fourth pipe 26 is a refrigerant pipe that connects the liquid side (opposite to the gas side, and opposite to the side provided with the secondary-side switching mechanism 22) of the cascade heat exchanger 35 and the secondary-side receiver 45. Specifically, the fourth pipe 26 connects a liquid side end (opposite to the gas side) of the secondary-side flow path 35*a* in the cascade heat exchanger 35 and the secondary-side receiver 45.

The secondary-side receiver 45 is a refrigerant reservoir that reserves a residue refrigerant in the secondary-side refrigerant circuit 10. The secondary-side receiver 45 is provided with the fourth pipe 26, the fifth pipe 27, and the bypass circuit 46 extending outward.

The bypass circuit 46 is a refrigerant pipe that connects a gas phase region corresponding to an upper region in the secondary-side receiver 45 and the suction flow path 23. Specifically, the bypass circuit 46 is connected between the secondary-side switching mechanism 22 and the secondary-side accumulator 30 on the suction flow path 23. The bypass circuit 46 is provided with the bypass expansion valve 46*a*. The bypass expansion valve 46*a* is an electrically powered expansion valve having an adjustable opening degree to adjust quantity of the refrigerant guided from inside the secondary-side receiver 45 to the suction side of the secondary-side compressor 21.

The fifth pipe 27 is a refrigerant pipe that connects the secondary-side receiver 45 and the third shutoff valve 31.

The first electric component cooling flow path 17 is a refrigerant flow path that connects a portion X of the fourth pipe 26 between the cascade expansion valve 36 and the secondary-side receiver 45 and a portion Z of the fifth pipe 27 between the secondary-side subcooling heat exchanger 47 and the secondary-side receiver 45. The first electric component cooling flow path 17 includes a first electric component expansion valve 17*a* and a first cooling portion 11*a* for cooling a first electric component 91 (described later) of the cascade-side control unit 20. In the first electric component cooling flow path 17, the portion X, the first cooling portion 11*a*, the first electric component expansion valve 17*a*, and the portion Z are arranged in that order. The first electric component expansion valve 17*a* is an electric expansion valve that can adjust the flow rate of the secondary-side refrigerant flowing in the first electric component cooling flow path 17.

The second electric component cooling flow path 18 is a refrigerant flow path that connects a portion Y between the first cooling portion 11*a* and the first electric component expansion valve 17*a* on the first electric component cooling flow path 17 and a portion W in a halfway portion of the suction flow path 23. The second electric component cooling flow path 18 includes a second cooling portion 11*b* for cooling a space S2 in which a second electric component 92 (described later) and the first electric component 91 of the cascade-side control unit 20 are accommodated, and a second electric component expansion valve 18*a*. In the second electric component cooling flow path 18, the portion Y, the second electric component expansion valve 18*a*, the second cooling portion 11*b*, and the portion W are arranged in that order. The second electric component expansion valve 18*a* is an electric expansion valve that can decompress the secondary-side refrigerant after passing through the portion Y and before flowing to the second cooling portion 11*b*.

The secondary-side subcooling circuit 48 is a refrigerant pipe that connects a part of the fifth pipe 27 and the suction flow path 23. Specifically, the secondary-side subcooling circuit 48 is connected between the secondary-side switching mechanism 22 and the secondary-side accumulator 30 on the suction flow path 23. The secondary-side subcooling circuit 48 according to the present embodiment extends to branch from a portion between the secondary-side receiver 45 and the secondary-side subcooling heat exchanger 47.

The secondary-side subcooling heat exchanger 47 is configured to cause heat exchange between the refrigerant flowing in a flow path belonging to the fifth pipe 27 and the refrigerant flowing in a flow path belonging to the secondary-side subcooling circuit 48. The secondary-side subcooling heat exchanger 47 according to the present embodiment is provided between the third shutoff valve 31 and a portion from where the secondary-side subcooling circuit 48 branches on the fifth pipe 27. The secondary-side subcooling expansion valve 48*a* is provided between a portion branching from the fifth pipe 27 and the secondary-side subcooling heat exchanger 47 on the secondary-side subcooling circuit 48. The secondary-side subcooling expansion valve 48*a* supplies the secondary-side subcooling heat exchanger 47 with a decompressed refrigerant, and is an electrically powered expansion valve having an adjustable opening degree.

The secondary-side accumulator 30 is a reservoir that can reserve the secondary-side refrigerant, and is provided on the suction side of the secondary-side compressor 21.

The oil separator 34 is provided at a halfway portion of the discharge flow path 24. The oil separator 34 is configured to separate, from the secondary-side refrigerant, refrigerating machine oil discharged from the secondary-side compressor 21 along with the secondary-side refrigerant and return the refrigerating machine oil to the secondary-side compressor 21.

The oil return circuit 40 is provided to connect the oil separator 34 and the suction flow path 23. The oil return circuit 40 includes an oil return flow path 41 as a flow path extending from the oil separator 34 and extending to join a portion between the secondary-side accumulator 30 and the suction side of the secondary-side compressor 21 on the suction flow path 23. The oil return flow path 41 has a halfway portion provided with an oil return capillary tube 42 and an oil return on-off valve 44. When the oil return on-off valve 44 is controlled into an opened state, the refrigerating machine oil separated in the oil separator 34 passes through the oil return capillary tube 42 on the oil return flow path 41 and is returned to the suction side of the secondary-side compressor 21. When the secondary-side compressor 21 is in the operating state on the secondary-side refrigerant circuit 10, the oil return on-off valve 44 according to the present embodiment is kept in the opened state for predetermined time and is kept in a closed state for predetermined time repeatedly, to control returned quantity of the refrigerating machine oil through the oil return circuit 40. The oil return on-off valve 44 according to the present embodiment is an electromagnetic valve controlled to be opened and closed. Alternatively, the oil return on-off valve 44 may be an electrically powered expansion valve having an adjustable opening degree and not provided with the oil return capillary tube 42.

Description is made below to the utilization circuits 13*a*, 13*b*, and 13*c*. Since the utilization circuits 13*b* and 13*c* are configured similarly to the utilization circuit 13*a*, elements of the utilization circuits 13*b* and 13*c* will not be described repeatedly, assuming that a subscript "b" or "c" will replace a subscript "a" in reference signs denoting elements of the utilization circuit 13*a*.

The utilization circuit 13*a* mainly includes a utilization-side heat exchanger 52*a*, a first utilization pipe 57*a*, a second utilization pipe 56*a*, and a utilization-side expansion valve 51*a*.

The utilization-side heat exchanger 52*a* is configured to cause heat exchange between the refrigerant and indoor air, and includes a fin-and-tube heat exchanger constituted by large numbers of heat transfer tubes and fins. A plurality of utilization-side heat exchangers 52*a*, 52*b*, and 52*c* are connected in parallel to the secondary-side switching mechanism 22, the suction flow path 23, and the cascade heat exchanger 35.

The second utilization pipe 56*a* has one end connected to a liquid side (opposite to a gas side) of the utilization-side heat exchanger 52*a* in the first utilization unit 3*a*. The second utilization pipe 56*a* has the other end connected to the second connecting tube 16*a*. The second utilization pipe 56*a* has a halfway portion provided with the utilization-side expansion valve 51*a* described above.

The utilization-side expansion valve 51*a* is an electrically powered expansion valve that has an adjustable opening degree and adjusts a flow rate of the refrigerant flowing in the utilization-side heat exchanger 52*a*. The utilization-side expansion valve 51*a* is provided on the second utilization pipe 56*a*.

The first utilization pipe 57*a* has one end connected to the gas side of the utilization-side heat exchanger 52*a* in the first utilization unit 3*a*. The first utilization pipe 57*a* according to the present embodiment is connected to a portion opposite to the utilization-side expansion valve 51*a* of the utilization-side heat exchanger 52*a*. The first utilization pipe 57*a* has the other end connected to the first connecting tube 15*a*.

Description is made below to the branch circuits 14*a*, 14*b*, and 14*c*. Since the branch circuits 14*b* and 14*c* are configured similarly to the branch circuit 14*a*, elements of the branch circuits 14*b* and 14*c* will not be described repeatedly, assuming that a subscript "b" or "c" will replace a subscript "a" in reference signs denoting elements of the branch circuit 14*a*.

The branch circuit 14*a* mainly includes a junction pipe 62*a*, a first branch pipe 63*a*, a second branch pipe 64*a*, a first control valve 66*a*, a second control valve 67*a*, a bypass pipe 69*a*, a check valve 68*a*, and a third branch pipe 61*a*.

The junction pipe 62*a* has one end connected to the first connecting tube 15*a*. The other end of the junction pipe 62*a* is connected to the first branch pipe 63*a* and the second branch pipe 64*a* which are branched from the junction pipe.

The first branch pipe 63*a* has a portion not adjacent to the junction pipe 62 and connected to the secondary-side first connection pipe 8. The first branch pipe 63*a* is provided with the openable and closable first control valve 66*a*.

The second branch pipe 64*a* has a portion not adjacent to the junction pipe 62 and connected to the secondary-side second connection pipe 9. The second branch pipe 64*a* is provided with the openable and closable second control valve 67*a*.

The bypass pipe 69*a* is a refrigerant pipe that connects a portion of the first branch pipe 63*a* closer to the secondary-side first connection pipe 8 than the first control valve 66*a* and a portion of the second branch pipe 64*a* closer to the secondary-side second connection pipe 9 than the second control valve 67*a*. The check valve 68*a* is provided in a halfway portion of the bypass pipe 69*a*. The check valve 68*a* allows only a refrigerant flow from the second branch pipe 64*a* toward the first branch pipe 63*a*, and does not allow a refrigerant flow from the first branch pipe 63*a* toward the second branch pipe 64*a*.

The third branch pipe 61*a* has one end connected to the second connecting tube 16*a*. The third branch pipe 61*a* has the other end connected to the secondary-side third connection pipe 7.

Then, the first branch unit 6*a* can function as follows by closing the first control valve 66*a* and opening the second control valve 67*a* when the cooling operation described later is performed. The first branch unit 6*a* sends a refrigerant flowing into the third branch pipe 61*a* through the secondary-side third connection pipe 7 to the second connecting tube 16*a*. The refrigerant flowing in the second utilization pipe 56*a* in the first utilization unit 3*a* via the second connecting tube 16*a* is sent to the utilization-side heat exchanger 52*a* in the first utilization unit 3*a* via the utilization-side expansion valve 51*a*. Then, the refrigerant sent to the utilization-side heat exchanger 52*a* is evaporated by heat exchange with indoor air, and then flows in the first connecting tube 15*a* via the first utilization pipe 57*a*. The refrigerant having flowed through the first connecting tube 15*a* is sent to the junction pipe 62*a* of the first branch unit 6*a*. The refrigerant having flowed through the junction pipe 62*a* does not flow toward the first branch pipe 63*a* but flows toward the second branch pipe 64*a*. The refrigerant flowing in the second branch pipe 64*a* passes through the second control valve 67*a*. A part of the refrigerant that has passed through the second control valve 67*a* is sent to the secondary-side second connection pipe 9. A remaining part of the refrigerant that has passed through the second control valve 67*a* flows so as to branch into the bypass pipe 69*a* provided with the check valve 68*a*, passes through a part of the first branch pipe 63*a*, and then is sent to the secondary-side first connection pipe 8. As a result, it is possible to increase a total flow path cross-sectional area when the secondary-side gas state refrigerant evaporated in the utilization-side heat exchanger 52*a* is sent to the secondary-side compressor 21, so that pressure loss can be reduced.

When the first utilization unit 3*a* cools a room at the time of performing the cooling main operation and the heating main operation to be described later, the first branch unit 6*a* can function as follows by closing the first control valve 66*a* and opening the second control valve 67*a*. The first branch unit 6*a* sends a refrigerant flowing into the third branch pipe 61*a* through the secondary-side third connection pipe 7 to the second connecting tube 16*a*. The refrigerant flowing in the second utilization pipe 56*a* in the first utilization unit 3*a* via the second connecting tube 16*a* is sent to the utilization-side heat exchanger 52*a* in the first utilization unit 3*a* via the utilization-side expansion valve 51*a*. Then, the refrigerant sent to the utilization-side heat exchanger 52*a* is evaporated by heat exchange with indoor air, and then flows in the first connecting tube 15*a* via the first utilization pipe 57*a*. The refrigerant having flowed through the first connecting tube 15*a* is sent to the junction pipe 62*a* of the first branch unit 6*a*. The refrigerant having flowed through the junction pipe 62*a* flows to the second branch pipe 64*a*, passes through the second control valve 67*a*, and then is sent to the secondary-side second connection pipe 9.

The first branch unit 6*a* can function as follows by closing the second control valve 67*a* and opening the first control valve 66*a* when the heating operation described later is performed. In the first branch unit 6*a*, the refrigerant flowing into the first branch pipe 63*a* through the secondary-side first connection pipe 8 passes through the first control valve 66*a* and is sent to the junction pipe 62*a*. The refrigerant having flowed through the junction pipe 62*a* flows in the first utilization pipe 57*a* in the utilization unit 3*a* via the first connecting tube 15*a* to be sent to the utilization-side heat exchanger 52*a*. Then, the refrigerant sent to the utilization-side heat exchanger 52*a* radiates heat through heat exchange with indoor air, and then passes through the utilization-side expansion valve 51*a* provided on the second utilization pipe 56*a*. The refrigerant having passed through the second utilization pipe 56*a* flows through the third branch pipe 61*a* of the first branch unit 6*a* via the second connecting tube 16*a*, and then is sent to the secondary-side third connection pipe 7.

When the first utilization unit 3*a* heats a room at the time of performing the cooling main operation and the heating main operation described later, the first branch unit 6*a* can function as follows by closing the second control valve 67*a* and opening the first control valve 66*a*. In the first branch unit 6*a*, the refrigerant flowing into the first branch pipe 63*a* through the secondary-side first connection pipe 8 passes through the first control valve 66*a* and is sent to the junction pipe 62*a*. The refrigerant having flowed through the junction pipe 62*a* flows in the first utilization pipe 57*a* in the utilization unit 3*a* via the first connecting tube 15*a* to be sent to the utilization-side heat exchanger 52*a*. Then, the refrigerant sent to the utilization-side heat exchanger 52*a* radiates heat through heat exchange with indoor air, and then passes through the utilization-side expansion valve 51*a* provided on the second utilization pipe 56*a*. The refrigerant having passed through the second utilization pipe 56*a* flows through the third branch pipe 61*a* of the first branch unit 6*a* via the second connecting tube 16*a*, and then is sent to the secondary-side third connection pipe 7.

The first branch unit 6*a*, as well as the second branch unit 6*b* and the third branch unit 6*c*, similarly have such a function. Accordingly, the first branch unit 6*a*, the second branch unit 6*b*, and the third branch unit 6*c* can individually switchably cause the utilization-side heat exchangers 52*a*, 52*b*, and 52*c* to function as a refrigerant evaporator or a refrigerant radiator.

(4) Primary-Side Unit

The primary-side unit 5 is disposed in a space different from a space provided with the utilization units 3*a*, 3*b*, and 3*c* and the branch units 6*a*, 6*b*, and 6*c*, on a roof, or the like.

The primary-side unit 5 includes a part of the primary-side refrigerant circuit 5*a* described above, a primary-side fan 75, various sensors, a primary-side control unit 70, and a primary-side casing 5*x* as shown in FIG. 7.

The primary-side unit 5 includes, as a part of the primary-side refrigerant circuit 5*a*, the primary-side compressor 71, the primary-side switching mechanism 72, the primary-side heat exchanger 74, the primary-side first expansion valve 76, the primary-side subcooling heat exchanger 103, the primary-side subcooling circuit 104, the primary-side subcooling expansion valve 104*a*, the first liquid shutoff valve 108, the first gas shutoff valve 109, and the primary-side accumulator 105 in the primary-side casing 5*x*.

The primary-side fan 75 is provided in the primary-side unit 5, and generates an air flow of guiding outdoor air into the primary-side heat exchanger 74 and exhausting, to outdoors, air obtained after heat exchange with the primary-side refrigerant flowing in the primary-side heat exchanger 74. The primary-side fan 75 is driven by a primary-side fan motor 75*a*.

The primary-side unit 5 is provided with the various sensors. Specifically, there are provided an outdoor air temperature sensor 77 that detects a temperature of outdoor air before passing through the primary-side heat exchanger 74, a primary-side discharge pressure sensor 78 that detects a pressure of the primary-side refrigerant discharged from the primary-side compressor 71, a primary-side suction pressure sensor 79 that detects a pressure of the primary-side refrigerant sucked into the primary-side compressor 71, a primary-side suction temperature sensor 81 that detects a temperature of the primary-side refrigerant sucked into the primary-side compressor 71, and a primary-side heat exchange temperature sensor 82 that detects a temperature of the refrigerant flowing in the primary-side heat exchanger 74.

The primary-side control unit 70 controls behavior of the elements 71 (71*a*), 72, 75 (75*a*), 76, and 104*a* provided in the primary-side unit 5. Then, the primary-side control unit 70 includes a processor such as a CPU or a microcomputer provided to control the primary-side unit 5 and a memory, so as to transmit and receive control signals and the like to and from a remote controller (not shown), and to transmit and receive control signals and the like between the cascade-side control unit 20 in the cascade unit 2, branch unit control units 60*a*, 60*b*, and 60*c*, and utilization-side control units 50*a*, 50*b*, and 50*c*.

(5) Cascade Unit

The cascade unit 2 is disposed in a space different from a space provided with the utilization units 3*a*, 3*b*, and 3*c* and the branch units 6*a*, 6*b*, and 6*c*, on a roof, or the like.

The cascade unit 2 is connected to the branch units 6*a*, 6*b*, and 6*c* via the connection pipes 7, 8, and 9, to constitute a part of the secondary-side refrigerant circuit 10. The cascade unit 2 is connected to the primary-side unit 5 via the primary-side first connection pipe 111 and the primary-side second connection pipe 112, to constitute a part of the primary-side refrigerant circuit 5*a*.

The cascade unit 2 mainly includes the cascade circuit 12 described above, various sensors, the cascade-side control unit 20, the second liquid shutoff valve 106, the second refrigerant pipe 114, the primary-side second expansion valve 102, the first refrigerant pipe 113, and the second gas shutoff valve 107 that constitute a part of the primary-side refrigerant circuit 5*a*, and the cascade casing 2*x* as shown in FIG. 7.

The cascade unit 2 is provided with a secondary-side suction pressure sensor 37 that detects a pressure of the secondary-side refrigerant on the suction side of the secondary-side compressor 21, a secondary-side discharge pressure sensor 38 that detects a pressure of the secondary-side refrigerant on the discharge side of the secondary-side compressor 21, a secondary-side discharge temperature sensor 39 that detects a temperature of the secondary-side refrigerant on the discharge side of the secondary-side compressor 21, a secondary-side suction temperature sensor 88 that detects a temperature of the secondary-side refrigerant on the suction side of the secondary-side compressor 21, a secondary-side cascade temperature sensor 83 that detects a temperature of the secondary-side refrigerant flowing between the secondary-side flow path 35*a* of the cascade heat exchanger 35 and the cascade expansion valve 36, a receiver outlet temperature sensor 84 that detects a temperature of the secondary-side refrigerant flowing between the secondary-side receiver 45 and the secondary-side subcooling heat exchanger 47, a bypass circuit temperature sensor 85 that detects a temperature of the secondary-side refrigerant flowing downstream of the bypass expansion valve 46*a* in the bypass circuit 46, a subcooling outlet temperature sensor 86 that detects a temperature of the secondary-side refrigerant flowing between the secondary-side subcooling heat exchanger 47 and the third shutoff valve 31, and a subcooling circuit temperature sensor 87 that detects a temperature of the secondary-side refrigerant flowing through an outlet of the secondary-side subcooling heat exchanger 47 in the secondary-side subcooling circuit 48.

The cascade-side control unit 20 controls behavior of the elements 17*a*, 18*a*, 21 (21*a*), 22, 36, 44, 46*a*, 48*a*, and 102 provided in the cascade casing 2*x* of the cascade unit 2. The cascade-side control unit 20 includes a processor such as a CPU or a microcomputer provided to control the cascade unit 2 and a memory, so as to transmit and receive control signals and the like between the primary-side control unit 70 in the primary-side unit 5, the utilization-side control units 50*a*, 50*b*, and 50*c* in the utilization units 3*a*, 3*b*, and 3*c*, and the branch unit control units 60*a*, 60*b*, and 60*c*.

As described above, the cascade-side control unit 20 can control not only the units constituting the cascade circuit 12 of the secondary-side refrigerant circuit 10 but also the primary-side second expansion valve 102 constituting a part of the primary-side refrigerant circuit 5*a*. Therefore, the cascade-side control unit 20 controls the valve opening degree of the primary-side second expansion valve 102 on the basis of a condition of the cascade circuit 12 controlled by the cascade-side control unit 20, so as to bring the condition of the cascade circuit 12 closer to a desired condition. Specifically, it is possible to control an amount of heat received by the secondary-side refrigerant flowing through the secondary-side flow path 35*a* of the cascade heat exchanger 35 in the cascade circuit 12 from the primary-side refrigerant flowing through the primary-side flow path 35*b* of the cascade heat exchanger 35 or an amount of heat given by the secondary-side refrigerant to the primary-side refrigerant.

(6) Utilization Unit

The utilization units 3*a*, 3*b*, and 3*c* are installed by being embedded in or being suspended from a ceiling in an indoor space of an office building or the like, or by being hung on a wall surface in the indoor space, or the like.

The utilization units 3*a*, 3*b*, and 3*c* are connected to the cascade unit 2 via the connection pipes 7, 8, and 9.

The utilization units 3*a*, 3*b*, and 3*c* respectively include the utilization circuits 13*a*, 13*b*, and 13*c* constituting a part of the secondary-side refrigerant circuit 10.

Hereinafter, configurations of the utilization units 3*a*, 3*b*, and 3*c* are described. The second utilization unit 3*b* and the third utilization unit 3*c* are configured similarly to the first utilization unit 3*a*. The configuration of only the first utilization unit 3*a* will thus be described here. As for the configuration of each of the second utilization unit 3*b* and the third utilization unit 3*c*, elements will be denoted by reference signs obtained by replacing a subscript "a" in reference signs of elements of the first utilization unit 3*a* with a subscript "b" or "c", and these elements will not be described repeatedly.

The first utilization unit 3*a* mainly includes the utilization circuit 13*a* described above, an indoor fan 53*a*, the utilization-side control unit 50*a*, and various sensors. Note that the indoor fan 53*a* includes an indoor fan motor 54*a*.

The indoor fan 53*a* generates an air flow of sucking indoor air into the unit and supplying the indoor space with supply air obtained after heat exchange with the refrigerant flowing in the utilization-side heat exchanger 52*a*. The indoor fan 53*a* is driven by the indoor fan motor 54*a*.

The utilization unit 3*a* is provided with a liquid-side temperature sensor 58*a* that detects a temperature of a refrigerant on the liquid side of the utilization-side heat exchanger 52*a*. The utilization unit 3*a* is further provided with an indoor temperature sensor 55*a* that detects an indoor temperature as a temperature of air introduced from the indoor space before passing through the utilization-side heat exchanger 52*a*.

The utilization-side control unit 50*a* controls behavior of the elements 51*a* and 53*a* (54*a*) of the utilization unit 3*a*. Then, the utilization-side control unit 50*a* includes a processor such as a CPU or a microcomputer provided to control the utilization unit 3*a* and a memory, so as to transmit and receive control signals and the like to and from the remote controller (not shown), and to transmit and receive control signals and the like among the cascade-side control unit 20 in the cascade unit 2, the branch unit control units 60*a*, 60*b*, and 60*c*, and the primary-side control unit 70 in the primary-side unit 5.

Note that the second utilization unit 3*b* includes the utilization circuit 13*b*, an indoor fan 53*b*, the utilization-side control unit 50*b*, and an indoor fan motor 54*b*. The third utilization unit 3*c* includes the utilization circuit 13*c*, an indoor fan 53*c*, the utilization-side control unit 50*c*, and an indoor fan motor 54*c*.

(7) Branch Unit

The branch units 6*a*, 6*b*, and 6*c* are installed in a space behind the ceiling of the indoor space of an office building or the like.

Each of the branch units 6*a*, 6*b*, and 6*c* is connected to a corresponding one of the utilization units 3*a*, 3*b*, and 3*c* on one-on-one basis. The branch units 6*a*, 6*b*, and 6*c* are connected to the cascade unit 2 via the connection pipes 7, 8, and 9.

Next, configurations of the branch units 6*a*, 6*b*, and 6*c* will be described. The second branch unit 6*b* and the third branch unit 6*c* are configured similarly to the first branch unit 6*a*. The configuration of only the first branch unit 6*a* will thus be described here. As for the configuration of each of the second branch unit 6*b* and the third branch unit 6*c*, elements will be denoted by reference signs obtained by replacing a subscript "a" in reference signs of elements of the first branch unit 6*a* with a subscript "b" or "c", and these elements will not be described repeatedly.

The first branch unit 6*a* mainly includes the branch circuit 14*a* and the branch unit control unit 60*a* described above.

The branch unit control unit 60*a* controls behavior of the elements 66*a* and 67*a* of the branch unit 6*a*. Then, the branch unit control unit 60*a* includes a processor such as a CPU or a microcomputer provided to control the branch unit 6*a* and a memory, so as to transmit and receive control signals and the like to and from the remote controller (not shown), and to transmit and receive control signals and the like between the cascade-side control unit 20 in the cascade unit 2, the utilization units 3*a*, 3*b*, and 3*c*, and the primary-side control unit 70 in the primary-side unit 5.

Note that the second branch unit 6*b* includes the branch circuit 14*b* and the branch unit control unit 60*b*. The third branch unit 6*c* includes the branch circuit 14*c* and the branch unit control unit 60*c*.

(8) Control Unit

In the refrigeration cycle apparatus 1, the cascade-side control unit 20, the utilization-side control units 50*a*, 50*b*, and 50*c*, the branch unit control units 60*a*, 60*b*, and 60*c*, and the primary-side control unit 70 described above are communicably connected to each other in a wired or wireless manner to constitute a control unit 80. Therefore, the control unit 80 controls behavior of the units 21(21*a*), 22, 36, 44, 46*a*, 48*a*, 51*a*, 51*b*, 51*c*, 53*a*, 53*b*, 53*c*(54*a*, 54*b*, 54*c*), 66*a*, 66*b*, 66*c*, 67*a*, 67*b*, 67*c*, 71(71*a*), 72, 75(75*a*), 76, 104*a* on the basis of detection information of the various sensors 37, 38, 39, 83, 84, 85, 86, 87, 88, 77, 78, 79, 81, 82, 58*a*, 58*b*, 58*c*, and the like, and instruction information received from a remote controller (not shown) and the like.

(9) Behavior of Refrigeration Cycle Apparatus

Next, behavior of the refrigeration cycle apparatus 1 will be described with reference to FIGS. 3 to 6.

Refrigeration cycle operation of the refrigeration cycle apparatus 1 can be mainly divided into the cooling operation, the heating operation, the cooling main operation, and the heating main operation.

Here, the cooling operation is refrigeration cycle operation in which only the utilization unit in which the utilization-side heat exchanger functions as a refrigerant evaporator exists, and the cascade heat exchanger 35 functions as a radiator for the secondary-side refrigerant for an evaporation load of the entire utilization unit.

The heating operation corresponds to refrigeration cycle operation in a case where only the utilization units in which the utilization-side heat exchanger functions as a refrigerant radiator exists, and the cascade heat exchanger 35 functions as an evaporator for the secondary-side refrigerant for a radiation load of the entire utilization unit.

The cooling main operation is operation in which the utilization unit in which the utilization-side heat exchanger functions as a refrigerant evaporator and the utilization unit in which the utilization-side heat exchanger functions as a refrigerant radiator are mixed. The cooling main operation is refrigeration cycle operation in which, when an evaporation load is a main thermal load of the entire utilization unit, the cascade heat exchanger 35 functions as a radiator for the secondary-side refrigerant in order to process the evaporation load of the entire utilization unit.

The heating main operation is operation in which the utilization unit in which the utilization-side heat exchanger functions as a refrigerant evaporator and the utilization unit in which the utilization-side heat exchanger functions as a refrigerant radiator are mixed. The heating main operation is refrigeration cycle operation in which, when a radiation load is a main heat load of the entire utilization unit, the cascade heat exchanger 35 functions as an evaporator for the secondary-side refrigerant in order to process the radiation load of the entire utilization unit.

Note that the behavior of the refrigeration cycle apparatus 1 including the refrigeration cycle operation is performed by the control unit 80 described above.

(9-1) Cooling Operation

Figure 3:
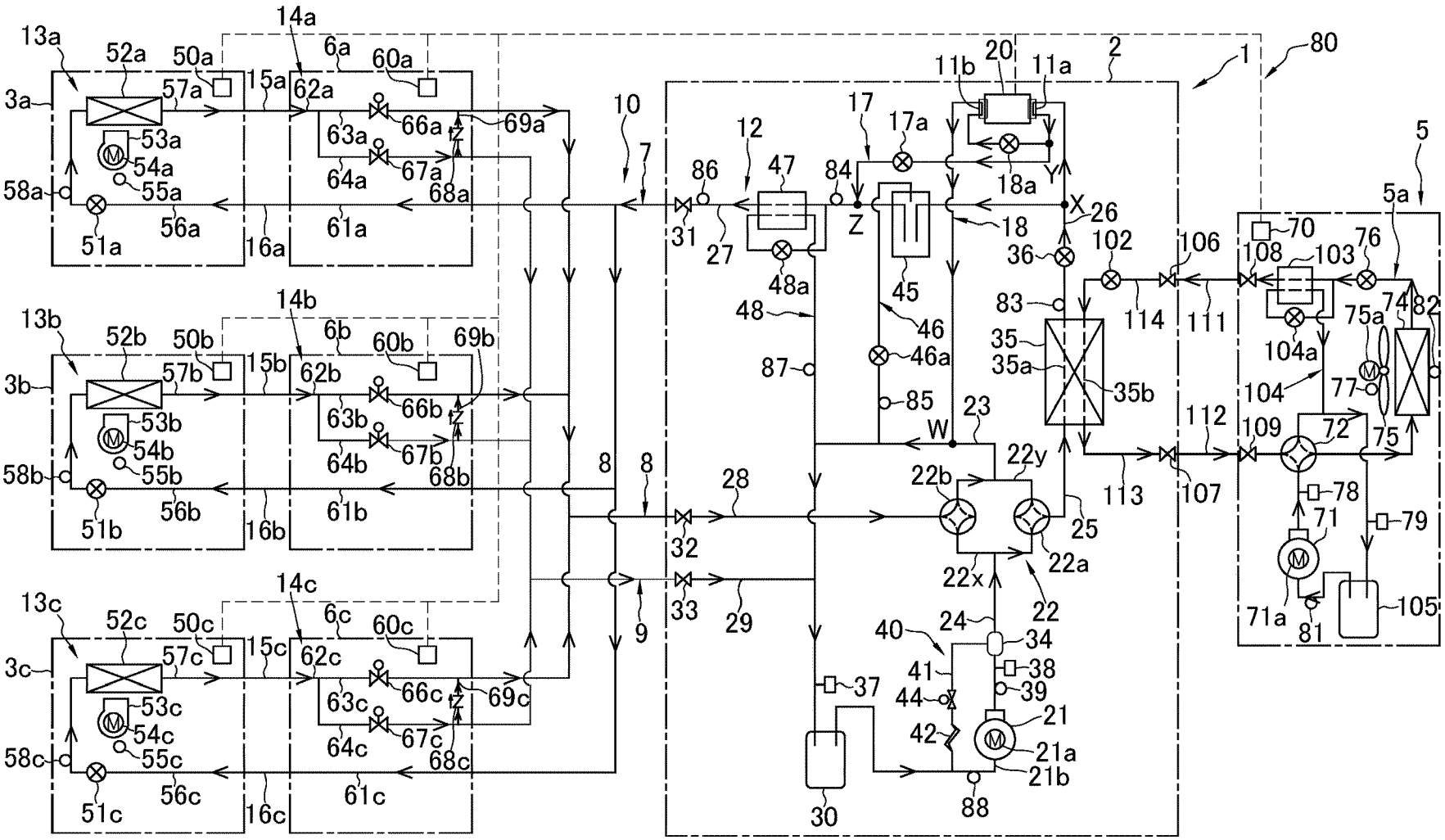
FIG. 3 is a diagram illustrating behavior (a flow of a refrigerant) in a cooling operation of the refrigeration cycle apparatus.

In the cooling operation, for example, each of the utilization-side heat exchangers 52*a*, 52*b*, and 52*c* in the utilization units 3*a*, 3*b*, and 3*c* functions as a refrigerant evaporator, and the cascade heat exchanger 35 functions as a radiator for the secondary-side refrigerant. In this cooling operation, the primary-side refrigerant circuit 5*a* and the secondary-side refrigerant circuit 10 of the refrigeration cycle apparatus 1 are configured as shown in FIG. 3. Note that arrows attached to the primary-side refrigerant circuit 5*a* and arrows attached to the secondary-side refrigerant circuit 10 in FIG. 3 indicate flows of the refrigerant during the cooling operation.

Specifically, in the primary-side unit 5, the primary-side switching mechanism 72 is switched to the fifth connecting state to cause the cascade heat exchanger 35 to function as an evaporator for the primary-side refrigerant. The fifth connecting state of the primary-side switching mechanism 72 is depicted by the solid lines of the primary-side switching mechanism 72 in FIG. 3. Accordingly, in the primary-side unit 5, the primary-side refrigerant discharged from the primary-side compressor 71 passes through the primary-side switching mechanism 72 and exchanges heat with outdoor air supplied from the primary-side fan 75 in the primary-side heat exchanger 74 to be condensed. The primary-side refrigerant condensed in the primary-side heat exchanger 74 passes through the primary-side first expansion valve 76 controlled into a fully opened state, and a part of the refrigerant flows toward the first liquid shutoff valve 108 via the primary-side subcooling heat exchanger 103, and another part of the refrigerant branches into the primary-side subcooling circuit 104. The refrigerant flowing in the primary-side subcooling circuit 104 is decompressed while passing through the primary-side subcooling expansion valve 104*a*. The refrigerant flowing from the primary-side first expansion valve 76 toward the first liquid shutoff valve 108 exchanges heat with the refrigerant decompressed by the primary-side subcooling expansion valve 104*a* and flowing in the primary-side subcooling circuit 104 in the primary-side subcooling heat exchanger 103, and is cooled until reaching a subcooled state. The refrigerant in the subcooled state flows through the primary-side first connection pipe 111, the second liquid shutoff valve 106, and the second refrigerant pipe 114 in that order, and is decompressed while passing through the primary-side second expansion valve 102. Here, a valve opening degree of the primary-side second expansion valve 102 is controlled such that a degree of superheating of the primary-side refrigerant sucked into the primary-side compressor 71 satisfies a predetermined condition. When flowing through the primary-side flow path 35*b* of the cascade heat exchanger 35, the primary-side refrigerant decompressed by the primary-side second expansion valve 102 evaporates by exchanging heat with the secondary-side refrigerant flowing through the secondary-side flow path 35*a*, and flows toward the second gas shutoff valve 107 through the first refrigerant pipe 113. The refrigerant having passed through the second gas shutoff valve 107 passes through the primary-side second connection pipe 112 and the first gas shutoff valve 109, and then reaches the primary-side switching mechanism 72. The refrigerant having passed through the primary-side switching mechanism 72 joins the refrigerant having flowed in the primary-side subcooling circuit 104, and is then sucked into the primary-side compressor 71 via the primary-side accumulator 105.

In the cascade unit 2, by switching the secondary-side switching mechanism 22 to the first connecting state, the cascade heat exchanger 35 functions as a radiator for the secondary-side refrigerant. In the first connecting state of the secondary-side switching mechanism 22, the discharge flow path 24 and the third pipe 25 are connected by the first switching valve 22*a*, and the first pipe 28 and the suction flow path 23 are connected by the second switching valve 22*b*. In the first to third utilization units 3*a*, 3*b*, and 3*c*, the second control valves 67*a*, 67*b*, and 67*c* are controlled into the opened state. Accordingly, each of the utilization-side heat exchangers 52*a*, 52*b*, and 52*c* in the utilization units 3*a*, 3*b*, and 3*c* functions as a refrigerant evaporator. All of the utilization-side heat exchangers 52*a*, 52*b*, and 52*c* of the utilization units 3*a*, 3*b*, and 3*c* and the suction side of the secondary-side compressor 21 of the cascade unit 2 are connected via the first utilization pipes 57*a*, 57*b*, and 57*c*, the first connecting tubes 15*a*, 15*b*, and 15*c*, the junction pipes 62*a*, 62*b*, and 62*c*, the second branch pipes 64*a*, 64*b*, and 64*c*, the bypass pipes 69*a*, 69*b*, and 69*c*, some of the first branch pipes 63*a*, 63*b*, and 63*c*, the secondary-side first connection pipe 8, and the secondary-side second connection pipe 9. The opening degree of the secondary-side subcooling expansion valve 48*a* is controlled such that a degree of subcooling of the secondary-side refrigerant flowing through the outlet of the secondary-side subcooling heat exchanger 47 toward the secondary-side third connection pipe 7 satisfies a predetermined condition. The bypass expansion valve 46*a* is controlled into the closed state. In the utilization units 3*a*, 3*b*, and 3*c*, the opening degrees of the utilization-side expansion valves 51*a*, 51*b*, and 51*c* are adjusted.

In the cooling operation, the secondary-side refrigerant circuit 10 controls capacity, for example, by controlling a frequency of the secondary-side compressor 21 such that evaporation temperature of the secondary-side refrigerant in the utilization-side heat exchangers 52*a*, 52*b*, and 52*c* becomes predetermined secondary-side evaporation target temperature. The opening degree of the cascade expansion valve 36 is adjusted such that the secondary-side refrigerant flowing through the cascade heat exchanger 35 has a critical pressure or less. The primary-side refrigerant circuit 5*a* controls capacity, for example, by controlling a frequency of the primary-side compressor 71 such that evaporation temperature of the primary-side refrigerant in the primary-side flow path 35*b* of the cascade heat exchanger 35 becomes predetermined primary-side evaporation target temperature. As described above, in the cooling operation, by executing either or both of the control for increasing the valve opening degree of the cascade expansion valve 36 and the control for increasing the frequency of the primary-side compressor 71 in the primary-side refrigerant circuit 5*a*, the carbon dioxide refrigerant flowing through the cascade heat exchanger 35 is controlled so as not to exceed a critical point.

The opening degree of the first electric component expansion valve 17*a* provided in the first electric component cooling flow path 17 is adjusted so as to be in the fully opened state or a predetermined opening degree. The second electric component expansion valve 18*a* provided in the second electric component cooling flow path 18 is adjusted to have a predetermined opening degree with which the secondary-side refrigerant passing through the second electric component expansion valve 18*a* can be decompressed. The valve opening degree of the second electric component expansion valve 18*a* may be controlled to satisfy such a condition that the secondary-side refrigerant after passing through the second cooling portion 11*b* has a predetermined degree of superheating or more, for example. In this case, for example, a temperature sensor of the secondary-side refrigerant flowing through a portion downstream of the second cooling portion 11*b* in the second electric component cooling flow path 18 may be used.

In such a secondary-side refrigerant circuit 10, a high-pressure secondary-side refrigerant compressed and discharged by the secondary-side compressor 21 is sent to the secondary-side flow path 35*a* of the cascade heat exchanger 35 through the first switching valve 22*a* of the secondary-side switching mechanism 22. The high-pressure secondary-side refrigerant flowing in the secondary-side flow path 35*a* of the cascade heat exchanger 35 radiates heat, and the primary-side refrigerant flowing in the primary-side flow path 35*b* of the cascade heat exchanger 35 evaporates. The secondary-side refrigerant having radiated heat in the cascade heat exchanger 35 passes through the cascade expansion valve 36 whose opening degree is adjusted, and then most of the refrigerant flows into the secondary-side receiver 45, and a remaining part of the refrigerant branches from the portion X toward the first electric component cooling flow path 17 and flows. The refrigerant flowing through the first electric component cooling flow path 17 and not in the critical state cools the first electric component 91 of the cascade-side control unit 20 when passing through the first cooling portion 11*a*. The refrigerant that has branched and flowed from the portion Y of the first electric component cooling flow path 17 to the second electric component cooling flow path 18 is decompressed when passing through the second electric component expansion valve 18*a*, becomes a refrigerant having a lower temperature, and is sent to the second cooling portion 11*b*. The refrigerant passing through the second cooling portion 11*b* cools the space S2 in which the second electric component 92 and the first electric component 91 of the cascade-side control unit 20 are provided. A part of the refrigerant having flowed out of the secondary-side receiver 45 branches into the secondary-side subcooling circuit 48, is decompressed at the secondary-side subcooling expansion valve 48*a*, and then joins into the suction flow path 23. In the secondary-side subcooling heat exchanger 47, another part of the refrigerant having flowed out of the secondary-side receiver 45 is cooled by the refrigerant flowing in the secondary-side subcooling circuit 48, and is then sent to the secondary-side third connection pipe 7 via the third shutoff valve 31.

Then, the refrigerant sent to the secondary-side third connection pipe 7 is branched into three portions to pass through the third branch pipes 61*a*, 61*b*, and 61*c* of the first to third branch units 6*a*, 6*b*, and 6*c*. Thereafter, the refrigerant having flowed through the second connecting tubes 16*a*, 16*b*, and 16*c* is sent to the second utilization pipes 56*a*, 56*b*, and 56*c* of the first to third utilization units 3*a*, 3*b*, and 3*c*. The refrigerant sent to the second utilization pipes 56*a*, 56*b*, and 56*c* is sent to the utilization-side expansion valves 51*a*, 51*b*, and 51*c* in the utilization units 3*a*, 3*b*, and 3*c*.

Then, the refrigerant having passed the utilization-side expansion valves 51*a*, 51*b*, and 51*c* whose opening degrees are adjusted exchanges heat with indoor air supplied by the indoor fans 53*a*, 53*b*, and 53*c* in the utilization-side heat exchangers 52*a*, 52*b*, and 52*c*. The refrigerant flowing in the utilization-side heat exchangers 52*a*, 52*b*, and 52*c* is thus evaporated into a low-pressure gas refrigerant. Indoor air is cooled and is supplied into the indoor space. The indoor space is thus cooled. The low-pressure gas refrigerant evaporated in the utilization-side heat exchangers 52*a*, 52*b*, and 52*c* flows through the first utilization pipes 57*a*, 57*b*, and 57*c*, flows through the first connecting tubes 15*a*, 15*b*, and 15*c*, and then is sent to the junction pipes 62*a*, 62*b*, and 62*c* of the first to third branch units 6*a*, 6*b*, and 6*c*.

Then, the low-pressure gas refrigerant sent to the junction pipes 62*a*, 62*b*, and 62*c* flows to the second branch pipes 64*a*, 64*b*, and 64*c*. A part of the refrigerant that has passed through the second control valves 67*a*, 67*b*, and 67*c* in the second branch pipes 64*a*, 64*b*, and 64*c* is sent to the secondary-side second connection pipe 9. A remaining part of the refrigerant that has passed through the second control valves 67*a*, 67*b*, and 67*c* passes through the bypass pipes 69*a*, 69*b*, and 69*c*, flows through a part of the first branch pipes 63*a*, 63*b*, and 63*c*, and then is sent to the secondary-side first connection pipe 8.

Then, the low-pressure gas refrigerant sent to the secondary-side first connection pipe 8 and the secondary-side second connection pipe 9 is returned to the suction side of the secondary-side compressor 21 through the first shutoff valve 32, the second shutoff valve 33, the first pipe 28, the second pipe 29, the second switching valve 22*b* of the secondary-side switching mechanism 22, the suction flow path 23, and the secondary-side accumulator 30.

Behavior during the cooling operation is executed in this manner.

(9-2) Heating Operation

Figure 4:
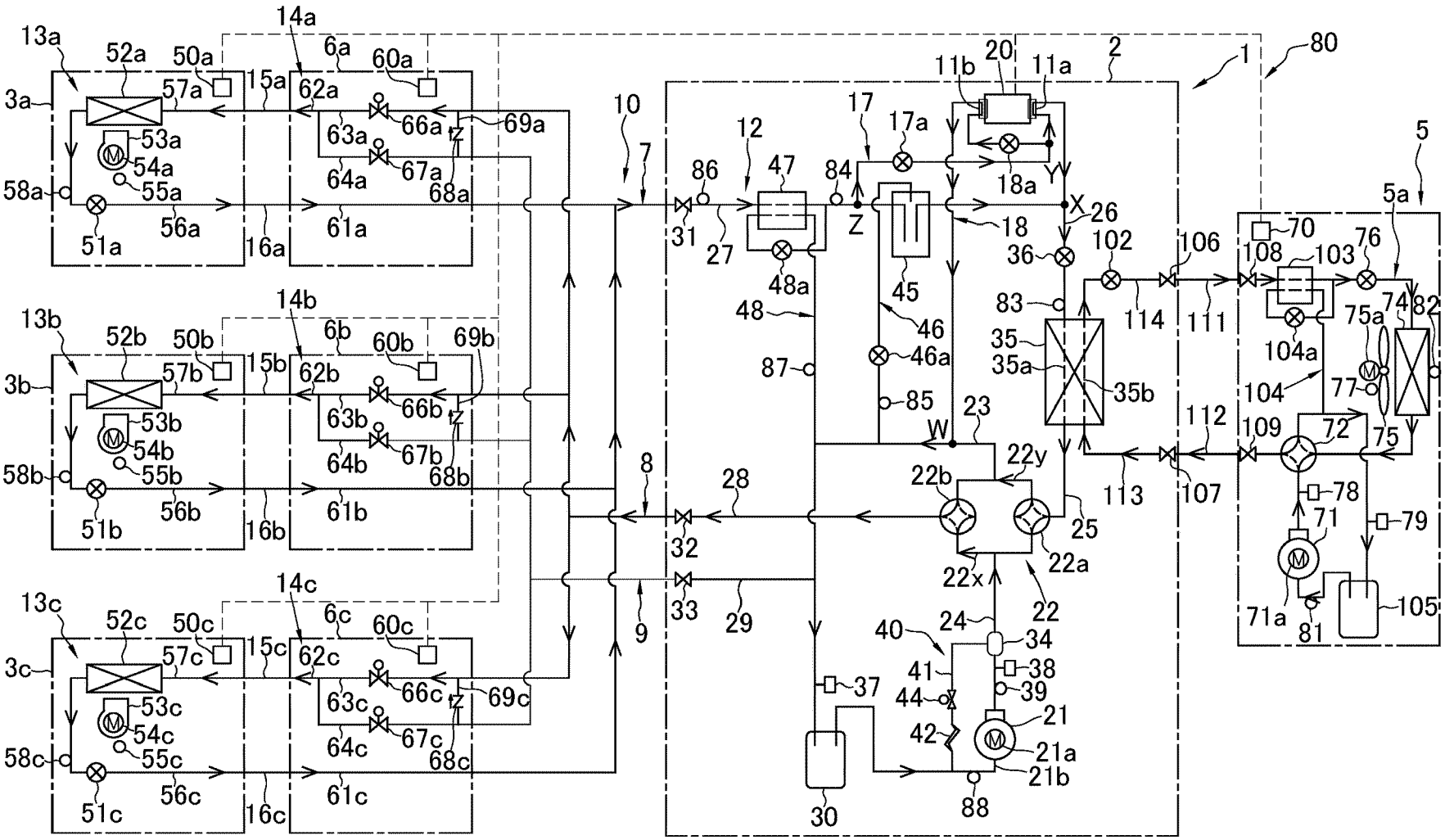
FIG. 4 is a diagram illustrating behavior (a flow of a refrigerant) in a heating operation of the refrigeration cycle apparatus.

In the heating operation, each of the utilization-side heat exchangers 52*a*, 52*b*, and 52*c* in the utilization units 3*a*, 3*b*, and 3*c* functions as a refrigerant radiator. In the heating operation, the cascade heat exchanger 35 operates to function as an evaporator for the secondary-side refrigerant. In the heating operation, the primary-side refrigerant circuit 5*a* and the secondary-side refrigerant circuit 10 of the refrigeration cycle apparatus 1 are configured as shown in FIG. 4. Arrows attached to the primary-side refrigerant circuit 5*a* and arrows attached to the secondary-side refrigerant circuit 10 in FIG. 4 indicate flows of the refrigerant during the heating operation.

Specifically, in the primary-side unit 5, the primary-side switching mechanism 72 is switched to a sixth operating state to cause the cascade heat exchanger 35 to function as a radiator for the primary-side refrigerant. The sixth operating state of the primary-side switching mechanism 72 corresponds to a connecting state depicted by broken lines in the primary-side switching mechanism 72 in FIG. 4. Accordingly, in the primary-side unit 5, the primary-side refrigerant discharged from the primary-side compressor 71, having passed the primary-side switching mechanism 72 and the first gas shutoff valve 109, passes through the primary-side second connection pipe 112 and the second gas shutoff valve 107 to be sent to the primary-side flow path 35*b* of the cascade heat exchanger 35. The refrigerant flowing in the primary-side flow path 35*b* of the cascade heat exchanger 35 is condensed by exchanging heat with the secondary-side refrigerant flowing in the secondary-side flow path 35*a*. When flowing through the second refrigerant pipe 114, the primary-side refrigerant condensed in the cascade heat exchanger 35 passes through the primary-side second expansion valve 102 controlled into the fully opened state. The refrigerant that has passed through the primary-side second expansion valve 102 flows through the second liquid shutoff valve 106, the primary-side first connection pipe 111, the first liquid shutoff valve 108, and the primary-side subcooling heat exchanger 103 in that order, and is decompressed by the primary-side first expansion valve 76. During the heating operation, the primary-side subcooling expansion valve 104*a* is controlled into the closed state, so that the refrigerant does not flow into the primary-side subcooling circuit 104. Therefore, no heat is exchanged in the primary-side subcooling heat exchanger 103. The valve opening degree of the primary-side first expansion valve 76 is controlled such that, for example, a degree of superheating of the refrigerant sucked into the primary-side compressor 71 satisfies a predetermined condition. The refrigerant decompressed at the primary-side first expansion valve 76 exchanges heat with outdoor air supplied from the primary-side fan 75 in the primary-side heat exchanger 74 to be evaporated, and is sucked into the primary-side compressor 71 via the primary-side switching mechanism 72 and the primary-side accumulator 105.

In the cascade unit 2, the secondary-side switching mechanism 22 is switched to the second connecting state. The cascade heat exchanger 35 thus functions as an evaporator for the secondary-side refrigerant. In the second connecting state of the secondary-side switching mechanism 22, the discharge flow path 24 and the first pipe 28 are connected by the second switching valve 22*b*, and the third pipe 25 and the suction flow path 23 are connected by the first switching valve 22*a*. The opening degree of the cascade expansion valve 36 is adjusted. In the first to third branch units 6*a*, 6*b*, and 6*c*, the first control valves 66*a*, 66*b*, and 66*c* are controlled into the opened state, and the second control valves 67*a*, 67*b*, and 67*c* are controlled into the closed state. Accordingly, each of the utilization-side heat exchangers 52*a*, 52*b*, and 52*c* in the utilization units 3*a*, 3*b*, and 3*c* functions as a refrigerant radiator. Then, the utilization-side heat exchangers 52*a*, 52*b*, and 52*c* in the utilization units 3*a*, 3*b*, and 3*c* and the discharge side of the secondary-side compressor 21 in the cascade unit 2 are connected via the discharge flow path 24, the first pipe 28, the secondary-side first connection pipe 8, the first branch pipes 63*a*, 63*b*, and 63*c*, the junction pipes 62*a*, 62*b*, and 62*c*, the first connecting tubes 15*a*, 15*b*, and 15*c*, and the first utilization pipes 57*a*, 57*b*, and 57*c*. The secondary-side subcooling expansion valve 48*a* and the bypass expansion valve 46*a* are controlled into the closed state. In the utilization units 3*a*, 3*b*, and 3*c*, the opening degrees of the utilization-side expansion valves 51*a*, 51*b*, and 51*c* are adjusted.

In the heating operation, the secondary-side refrigerant circuit 10 controls capacity of the secondary-side compressor 21 so as to achieve a frequency at which the loads in the utilization-side heat exchangers 52*a*, 52*b*, and 52*c* can be processed. As a result, in the heating operation, control is performed such that the secondary-side refrigerant discharged from the secondary-side compressor 21 can be in the critical state exceeding the critical pressure. The primary-side refrigerant circuit 5*a* controls capacity, for example, by controlling the frequency of the primary-side compressor 71 so that condensation temperature of the primary-side refrigerant in the primary-side flow path 35*b* of the cascade heat exchanger 35 becomes predetermined primary-side condensation target temperature.

The opening degree of the first electric component expansion valve 17*a* provided in the first electric component cooling flow path 17 is adjusted so as to be in the fully opened state or a predetermined opening degree. The second electric component expansion valve 18*a* provided in the second electric component cooling flow path 18 is adjusted to have a predetermined opening degree with which the secondary-side refrigerant passing through the second electric component expansion valve 18*a* can be decompressed. The valve opening degree of the second electric component expansion valve 18*a* may be controlled to satisfy such a condition that the secondary-side refrigerant after passing through the second cooling portion 11*b* has a predetermined degree of superheating or more, for example.

In such a secondary-side refrigerant circuit 10, the high-pressure refrigerant compressed and discharged by the secondary-side compressor 21 is sent to the first pipe 28 through the second switching valve 22*b* of the secondary-side switching mechanism 22. The refrigerant sent to the first pipe 28 is sent to the secondary-side first connection pipe 8 via the first shutoff valve 32.

Then, the high-pressure refrigerant sent to the secondary-side first connection pipe 8 is branched into three portions to be sent to the first branch pipes 63*a*, 63*b*, and 63*c* in the utilization units 3*a*, 3*b*, and 3*c* in operation. The high-pressure refrigerant sent to the first branch pipes 63*a*, 63*b*, and 63*c* passes through the first control valves 66*a*, 66*b*, and 66*c*, and flows in the junction pipes 62*a*, 62*b*, and 62*c*. The refrigerant having flowed in the first connecting tubes 15*a*, 15*b*, and 15*c* and the first utilization pipes 57*a*, 57*b*, and 57*c* is then sent to the utilization-side heat exchangers 52*a*, 52*b*, and 52*c*.

Then, the high-pressure refrigerant sent to the utilization-side heat exchangers 52*a*, 52*b*, and 52*c* exchanges heat with indoor air supplied by the indoor fans 53*a*, 53*b*, and 53*c* in the utilization-side heat exchangers 52*a*, 52*b*, and 52*c*. The refrigerant flowing in the utilization-side heat exchangers 52*a*, 52*b*, and 52*c* thus radiates heat. Indoor air is heated and is supplied into the indoor space. The indoor space is thus heated. The refrigerant having radiated heat in the utilization-side heat exchangers 52*a*, 52*b*, and 52*c* flows in the second utilization pipes 56*a*, 56*b*, and 56*c* and passes the utilization-side expansion valves 51*a*, 51*b*, and 51*c* whose opening degrees are adjusted. The secondary-side refrigerant having passed through the utilization-side expansion valves 51*a*, 51*b*, and 51*c* has the critical pressure or less. Thereafter, the refrigerant having flowed through the second connecting tubes 16*a*, 16*b*, and 16*c* flows in the third branch pipes 61*a*, 61*b*, and 61*c* of the branch units 6*a*, 6*b*, and 6*c*.

Then, the refrigerant sent to the third branch pipes 61*a*, 61*b*, and 61*c* is sent to the secondary-side third connection pipe 7 to join.

Then, most of the refrigerant sent to the secondary-side third connection pipe 7 passes through the third shutoff valve 31 and then is sent to the cascade expansion valve 36, and a remaining part of the refrigerant branches from the portion Z toward the first electric component cooling flow path 17 and flows. The refrigerant flowing through the first electric component cooling flow path 17 and not in the critical state passes through the first cooling portion 11*a* after passing through the first electric component expansion valve 17*a*, and cools the first electric component 91 of the cascade-side control unit 20 at that time. The refrigerant that has branched and flowed from the portion Y of the first electric component cooling flow path 17 to the second electric component cooling flow path 18 is decompressed when passing through the second electric component expansion valve 18*a*, becomes a refrigerant having a lower temperature, and is sent to the second cooling portion 11*b*. The refrigerant passing through the second cooling portion 11*b* cools the space S2 in which the second electric component 92 and the first electric component 91 of the cascade-side control unit 20 are provided. The flow rate of the refrigerant sent to the cascade expansion valve 36 is adjusted by the cascade expansion valve 36, and then the refrigerant is sent to the cascade heat exchanger 35. In the cascade heat exchanger 35, the secondary-side refrigerant flowing in the secondary-side flow path 35*a* is evaporated into a low-pressure gas refrigerant and is sent to the secondary-side switching mechanism 22, and the primary-side refrigerant flowing in the primary-side flow path 35*b* of the cascade heat exchanger 35 is condensed. Then, the secondary-side low-pressure gas refrigerant sent to the first switching valve 22*a* of the secondary-side switching mechanism 22 is returned to the suction side of the secondary-side compressor 21 through the suction flow path 23 and the secondary-side accumulator 30.

Behavior during the heating operation is executed in this manner.

(9-3) Cooling Main Operation

Figure 5:
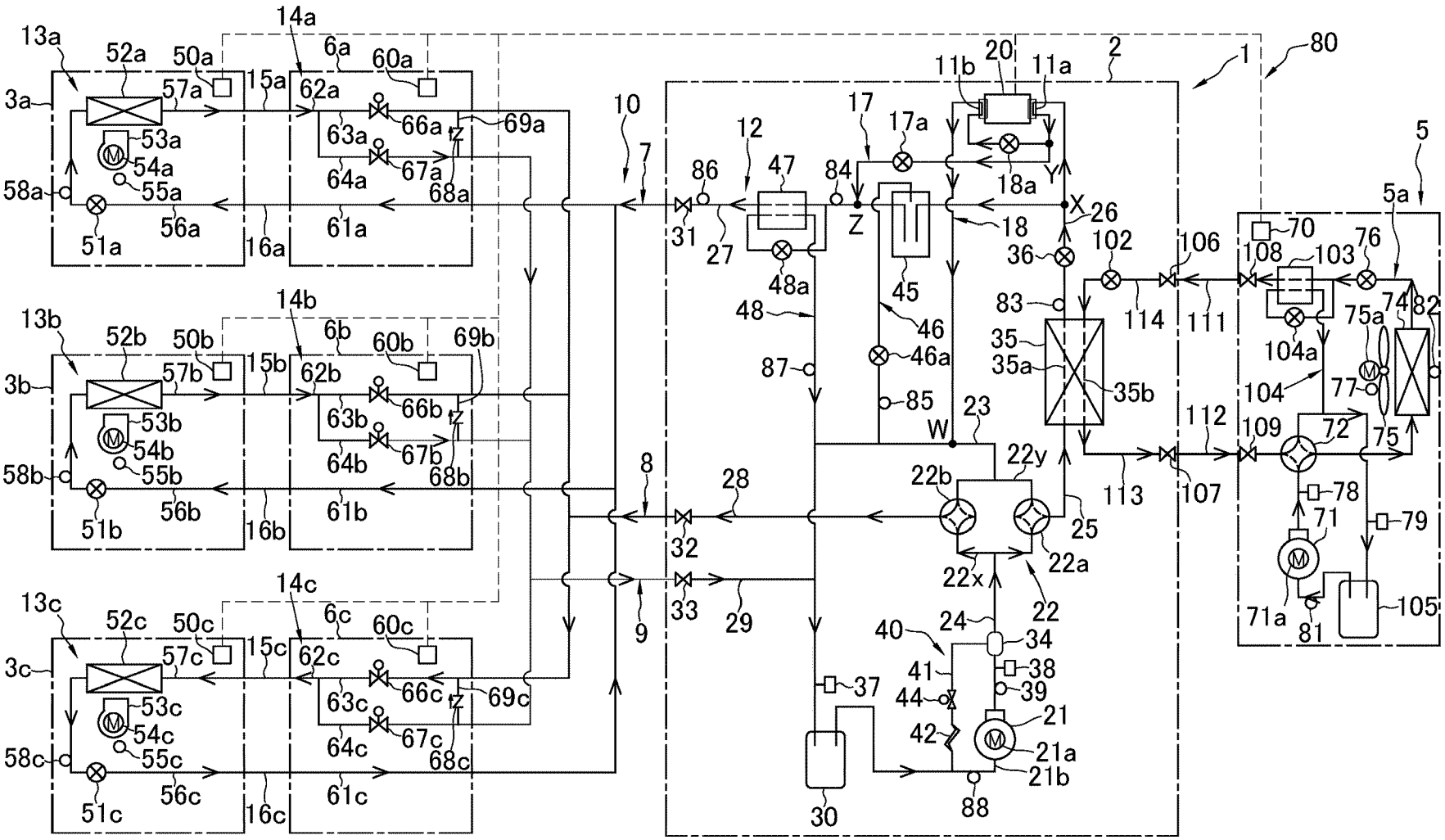
FIG. 5 is a diagram illustrating behavior (a flow of a refrigerant) in a simultaneous cooling and heating operation (cooling main operation) of the refrigeration cycle apparatus.

In the cooling main operation, for example, the utilization-side heat exchangers 52*a* and 52*b* in the utilization units 3*a* and 3*b* each function as a refrigerant evaporator, and the utilization-side heat exchanger 52*c* in the utilization unit 3*c* functions as a refrigerant radiator. In the cooling main operation, the cascade heat exchanger 35 functions as a radiator for the secondary-side refrigerant. In the cooling main operation, the primary-side refrigerant circuit 5*a* and the secondary-side refrigerant circuit 10 of the refrigeration cycle apparatus 1 are configured as shown in FIG. 5. Arrows attached to the primary-side refrigerant circuit 5*a* and arrows attached to the secondary-side refrigerant circuit 10 in FIG. 5 indicate flows of the refrigerant during the cooling main operation.

Specifically, in the primary-side unit 5, the primary-side switching mechanism 72 is switched to the fifth connecting state (the state depicted by solid lines in the primary-side switching mechanism 72 in FIG. 5) to cause the cascade heat exchanger 35 to function as an evaporator for the primary-side refrigerant. Accordingly, in the primary-side unit 5, the primary-side refrigerant discharged from the primary-side compressor 71 passes through the primary-side switching mechanism 72 and exchanges heat with outdoor air supplied from the primary-side fan 75 in the primary-side heat exchanger 74 to be condensed. The primary-side refrigerant condensed in the primary-side heat exchanger 74 passes through the primary-side first expansion valve 76 controlled into a fully opened state, and a part of the refrigerant flows toward the first liquid shutoff valve 108 via the primary-side subcooling heat exchanger 103, and another part of the refrigerant branches into the primary-side subcooling circuit 104. The refrigerant flowing in the primary-side subcooling circuit 104 is decompressed while passing through the primary-side subcooling expansion valve 104*a*. The refrigerant flowing from the primary-side first expansion valve 76 toward the first liquid shutoff valve 108 exchanges heat with the refrigerant decompressed by the primary-side subcooling expansion valve 104*a* and flowing in the primary-side subcooling circuit 104 in the primary-side subcooling heat exchanger 103, and is cooled until reaching a subcooled state. The refrigerant in the subcooled state flows through the primary-side first connection pipe 111, the second liquid shutoff valve 106, and the second refrigerant pipe 114 in that order, and is decompressed by the primary-side second expansion valve 102. At this time, for example, the valve opening degree of the primary-side second expansion valve 102 is controlled such that a degree of superheating of the refrigerant sucked into the primary-side compressor 71 satisfies a predetermined condition. When flowing through the primary-side flow path 35*b* of the cascade heat exchanger 35, the primary-side refrigerant decompressed by the primary-side second expansion valve 102 evaporates by exchanging heat with the secondary-side refrigerant flowing through the secondary-side flow path 35*a*, and flows toward the second gas shutoff valve 107 through the first refrigerant pipe 113. The refrigerant having passed through the second gas shutoff valve 107 passes through the primary-side second connection pipe 112 and the first gas shutoff valve 109, and then reaches the primary-side switching mechanism 72. The refrigerant having passed through the primary-side switching mechanism 72 joins the refrigerant having flowed in the primary-side subcooling circuit 104, and is then sucked into the primary-side compressor 71 via the primary-side accumulator 105.

In the cascade unit 2, the secondary-side switching mechanism 22 is switched to the third connecting state in which the discharge flow path 24 and the third pipe 25 are connected by the first switching valve 22*a* and the discharge flow path 24 and the first pipe 28 are connected by the second switching valve 22*b* to cause the cascade heat exchanger 35 to function as a radiator for the secondary-side refrigerant. The opening degree of the cascade expansion valve 36 is adjusted. In the first to third branch units 6*a*, 6*b*, and 6*c*, the first control valve 66*c* and the second control valves 67*a* and 67*b* are controlled into the opened state, and the first control valves 66*a* and 66*b* and the second control valve 67*c* are controlled into the closed state. Accordingly, the utilization-side heat exchangers 52*a* and 52*b* in the utilization units 3*a* and 3*b* each function as a refrigerant evaporator, and the utilization-side heat exchanger 52*c* in the utilization unit 3*c* functions as a refrigerant radiator. The utilization-side heat exchangers 52*a* and 52*b* in the utilization units 3*a* and 3*b* and the suction side of the secondary-side compressor 21 in the cascade unit 2 are connected via the secondary-side second connection pipe 9, and the utilization-side heat exchanger 52*c* in the utilization unit 3*c* and the discharge side of the secondary-side compressor 21 in the cascade unit 2 are connected via the secondary-side first connection pipe 8. The opening degree of the secondary-side subcooling expansion valve 48*a* is controlled such that a degree of subcooling of the secondary-side refrigerant flowing through the outlet of the secondary-side subcooling heat exchanger 47 toward the secondary-side third connection pipe 7 satisfies a predetermined condition. The bypass expansion valve 46*a* is controlled into the closed state. In the utilization units 3*a*, 3*b*, and 3*c*, the opening degrees of the utilization-side expansion valves 51*a*, 51*b*, and 51*c* are adjusted.

In the cooling main operation, the secondary-side refrigerant circuit 10 controls capacity, for example, by controlling the frequency of the secondary-side compressor 21 such that evaporation temperature in a heat exchanger functioning as an evaporator for the secondary-side refrigerant among the utilization-side heat exchanger 52*a*, 52*b*, and 52*c* becomes predetermined secondary-side evaporation target temperature. The opening degree of the cascade expansion valve 36 is adjusted such that the secondary-side refrigerant flowing through the cascade heat exchanger 35 has a critical pressure or less. The primary-side refrigerant circuit 5*a* controls capacity, for example, by controlling a frequency of the primary-side compressor 71 such that evaporation temperature of the primary-side refrigerant in the primary-side flow path 35*b* of the cascade heat exchanger 35 becomes predetermined primary-side evaporation target temperature. As described above, in the cooling operation, by executing either or both of the control for increasing the valve opening degree of the cascade expansion valve 36 and the control for increasing the frequency of the primary-side compressor 71 in the primary-side refrigerant circuit 5*a*, the carbon dioxide refrigerant flowing through the cascade heat exchanger 35 is controlled so as not to exceed a critical point.

The opening degree of the first electric component expansion valve 17*a* provided in the first electric component cooling flow path 17 is adjusted so as to be in the fully opened state or a predetermined opening degree. The second electric component expansion valve 18*a* provided in the second electric component cooling flow path 18 is adjusted to have a predetermined opening degree with which the secondary-side refrigerant passing through the second electric component expansion valve 18*a* can be decompressed. The valve opening degree of the second electric component expansion valve 18*a* may be controlled to satisfy such a condition that the secondary-side refrigerant after passing through the second cooling portion 11*b* has a predetermined degree of superheating or more, for example.

In such a secondary-side refrigerant circuit 10, a part of the secondary-side high-pressure refrigerant compressed and discharged by the secondary-side compressor 21 is sent to the secondary-side first connection pipe 8 through the second switching valve 22*b* of the secondary-side switching mechanism 22, the first pipe 28, and the first shutoff valve 32, and the rest is sent to the secondary-side flow path 35*a* of the cascade heat exchanger 35 through the first switching valve 22*a* of the secondary-side switching mechanism 22 and the third pipe 25.

Then, the high-pressure refrigerant sent to the secondary-side first connection pipe 8 is sent to the first branch pipe 63*c*. The high-pressure refrigerant sent to the first branch pipe 63*c* is sent to the utilization-side heat exchanger 52*c* in the utilization unit 3*c* via the first control valve 66*c* and the junction pipe 62*c*.

Then, the high-pressure refrigerant sent to the utilization-side heat exchanger 52*c* exchanges heat with indoor air supplied by the indoor fan 53*c* in the utilization-side heat exchanger 52*c*. The refrigerant flowing in the utilization-side heat exchanger 52*c* thus radiates heat. Indoor air is heated and is supplied into the indoor space, and the utilization unit 3*c* executes heating operation. The refrigerant having radiated heat in the utilization-side heat exchanger 52*c* flows in the second utilization pipe 56*c*, and the flow rate of the refrigerant is adjusted at the utilization-side expansion valve 51*c*. The refrigerant having flowed through the second connecting tube 16*c* is sent to the third branch pipe 61*c* in the branch unit 6*c*.

Then, the refrigerant sent to the third branch pipe 61*c* is sent to the secondary-side third connection pipe 7.

The high-pressure refrigerant sent to the secondary-side flow path 35*a* of the cascade heat exchanger 35 exchanges heat with the primary-side refrigerant flowing in the primary-side flow path 35*b* in the cascade heat exchanger 35 to radiate heat. The flow rate of the secondary-side refrigerant having radiated heat in the cascade heat exchanger 35 at the cascade expansion valve 36, and then most of the refrigerant flows into the secondary-side receiver 45, and a remaining part of the refrigerant branches from the portion X toward the first electric component cooling flow path 17 and flows. The refrigerant flowing through the first electric component cooling flow path 17 and not in the critical state cools the first electric component 91 of the cascade-side control unit 20 when passing through the first cooling portion 11*a*. The refrigerant that has branched and flowed from the portion Y of the first electric component cooling flow path 17 to the second electric component cooling flow path 18 is decompressed when passing through the second electric component expansion valve 18*a*, becomes a refrigerant having a lower temperature, and is sent to the second cooling portion 11*b*. The refrigerant passing through the second cooling portion 11*b* cools the space S2 in which the second electric component 92 and the first electric component 91 of the cascade-side control unit 20 are provided. A part of the refrigerant having flowed out of the secondary-side receiver 45 branches into the secondary-side subcooling circuit 48, is decompressed at the secondary-side subcooling expansion valve 48*a*, and then joins into the suction flow path 23. In the secondary-side subcooling heat exchanger 47, another part of the refrigerant having flowed out of the secondary-side receiver 45 is cooled by the refrigerant flowing in the secondary-side subcooling circuit 48, is then sent to the secondary-side third connection pipe 7 via the third shutoff valve 31, and joins the refrigerant having radiated heat in the utilization-side heat exchanger 52*c*.

Then, the refrigerant having joined in the secondary-side third connection pipe 7 is branched into two portions to be sent to the third branch pipes 61*a* and 61*b* of the branch units 6*a* and 6*b*. Thereafter, the refrigerant having flowed through the second connecting tubes 16*a* and 16*b* is sent to the second utilization pipes 56*a* and 56*b* of the first and second utilization units 3*a* and 3*b*. The refrigerant flowing in the second utilization pipes 56*a* and 56*b* passes the utilization-side expansion valves 51*a* and 51*b* in the utilization units 3*a* and 3*b*.

Then, the refrigerant having passed the utilization-side expansion valves 51*a* and 51*b* whose opening degrees are adjusted exchanges heat with indoor air supplied by the indoor fans 53*a* and 53*b* in the utilization-side heat exchangers 52*a* and 52*b*. The refrigerant flowing in the utilization-side heat exchangers 52*a* and 52*b* is thus evaporated into a low-pressure gas refrigerant. Indoor air is cooled and is supplied into the indoor space. The indoor space is thus cooled. The low-pressure gas refrigerant evaporated in the utilization-side heat exchangers 52*a* and 52*b* is sent to the junction pipes 62*a* and 62*b* of the first and second branch units 6*a* and 6*b*.

Then, the low-pressure gas refrigerant sent to the junction pipes 62*a* and 62*b* is sent to the secondary-side second connection pipe 9 via the second control valves 67*a* and 67*b* and the second branch pipes 64*a* and 64*b*, to join.

Then, the low-pressure gas refrigerant sent to the secondary-side second connection pipe 9 is returned to the suction side of the secondary-side compressor 21 via the second shutoff valve 33, the second pipe 29, the suction flow path 23, and the secondary-side accumulator 30.

Behavior during the cooling main operation is executed in this manner.

(9-4) Heating Main Operation

Figure 6:
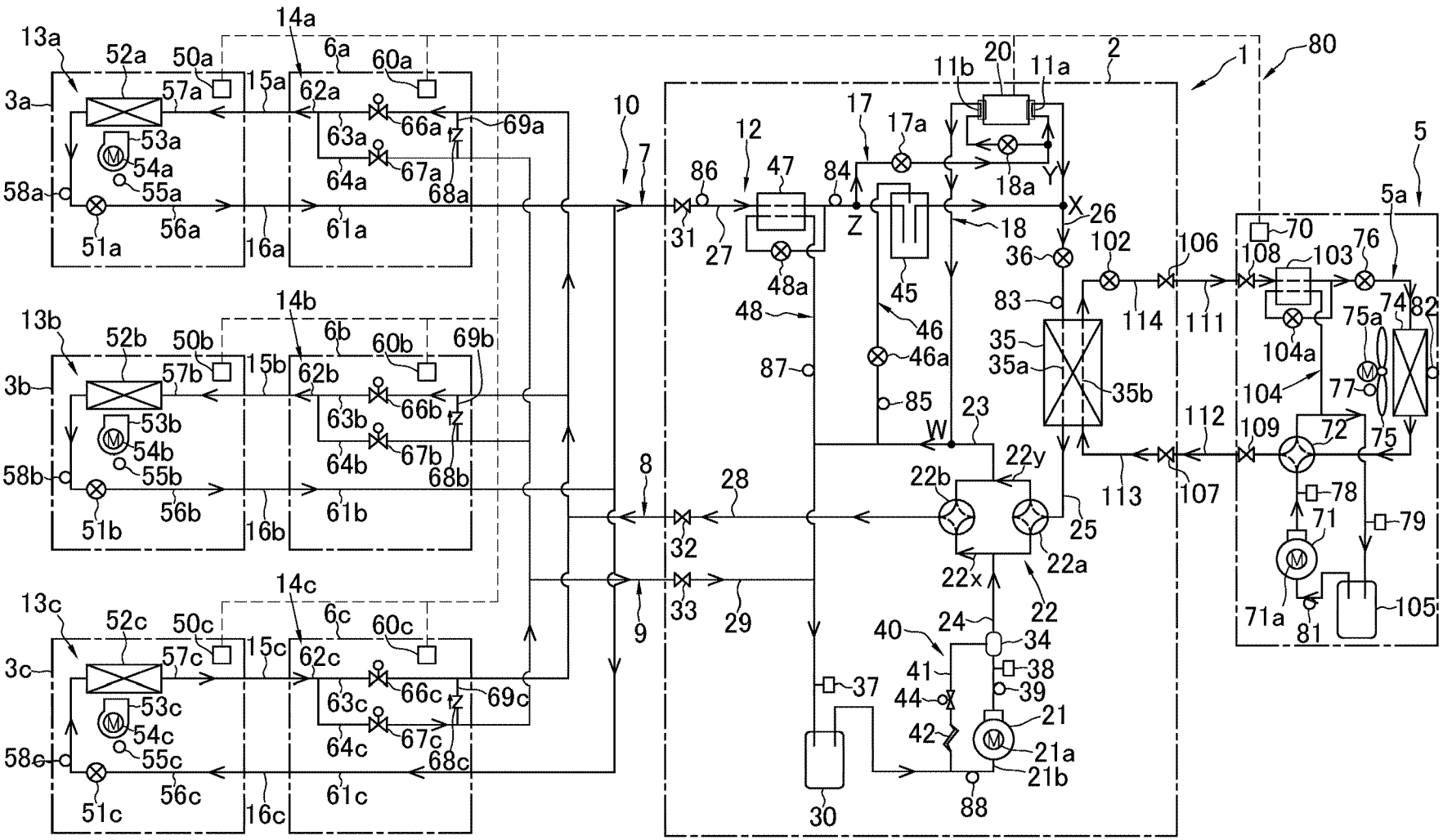
FIG. 6 is a diagram illustrating behavior (a flow of a refrigerant) in a simultaneous cooling and heating operation (heating main operation) of the refrigeration cycle apparatus.

In the heating main operation, for example, the utilization-side heat exchangers 52*a* and 52*b* in the utilization units 3*a* and 3*b* each function as a refrigerant radiator, and the utilization-side heat exchanger 52*c* functions as a refrigerant evaporator. In the heating main operation, the cascade heat exchanger 35 functions as an evaporator for the secondary-side refrigerant. In the heating main operation, the primary-side refrigerant circuit 5*a* and the secondary-side refrigerant circuit 10 of the refrigeration cycle apparatus 1 are configured as shown in FIG. 6. Arrows attached to the primary-side refrigerant circuit 5*a* and arrows attached to the secondary-side refrigerant circuit 10 in FIG. 6 indicate flows of the refrigerant during the heating main operation.

Specifically, in the primary-side unit 5, the primary-side switching mechanism 72 is switched to a sixth operating state to cause the cascade heat exchanger 35 to function as a radiator for the primary-side refrigerant. The sixth operating state of the primary-side switching mechanism 72 corresponds to a connecting state depicted by broken lines in the primary-side switching mechanism 72 in FIG. 6. Accordingly, in the primary-side unit 5, the primary-side refrigerant discharged from the primary-side compressor 71, having passed the primary-side switching mechanism 72 and the first gas shutoff valve 109, passes through the primary-side second connection pipe 112 and the second gas shutoff valve 107 to be sent to the primary-side flow path 35*b* of the cascade heat exchanger 35. The refrigerant flowing in the primary-side flow path 35*b* of the cascade heat exchanger 35 is condensed by exchanging heat with the secondary-side refrigerant flowing in the secondary-side flow path 35*a*. When flowing through the second refrigerant pipe 114, the primary-side refrigerant condensed in the cascade heat exchanger 35 passes through the primary-side second expansion valve 102 controlled into the fully opened state. Then, the primary-side refrigerant flows through the second liquid shutoff valve 106, the primary-side first connection pipe 111, the first liquid shutoff valve 108, and the primary-side subcooling heat exchanger 103 in that order, and is decompressed by the primary-side first expansion valve 76. During the heating main operation, the primary-side subcooling expansion valve 104*a* is controlled into the closed state, so that the refrigerant does not flow into the primary-side subcooling circuit 104. Therefore, no heat is exchanged in the primary-side subcooling heat exchanger 103. The valve opening degree of the primary-side first expansion valve 76 is controlled such that, for example, a degree of superheating of the refrigerant sucked into the primary-side compressor 71 satisfies a predetermined condition. The refrigerant decompressed at the primary-side first expansion valve 76 exchanges heat with outdoor air supplied from the primary-side fan 75 in the primary-side heat exchanger 74 to be evaporated, and is sucked into the primary-side compressor 71 via the primary-side switching mechanism 72 and the primary-side accumulator 105.

In the cascade unit 2, the secondary-side switching mechanism 22 is switched to the second connecting state. In the second connecting state of the secondary-side switching mechanism 22, the discharge flow path 24 and the first pipe 28 are connected by the second switching valve 22*b*, and the third pipe 25 and the suction flow path 23 are connected by the first switching valve 22*a*. The cascade heat exchanger 35 thus functions as an evaporator for the secondary-side refrigerant. The opening degree of the cascade expansion valve 36 is adjusted. In the first to third branch units 6*a*, 6*b*, and 6*c*, the first control valves 66*a* and 66*b* and the second control valve 67*c* are controlled into the opened state, and the first control valve 66*c* and the second control valves 67*a* and 67*b* are controlled into the closed state. Accordingly, the utilization-side heat exchangers 52*a* and 52*b* in the utilization units 3*a* and 3*b* each function as a refrigerant radiator, and the utilization-side heat exchanger 52*c* in the utilization unit 3*c* functions as a refrigerant evaporator. Then, the utilization-side heat exchanger 52*c* in the utilization unit 3*c* and the suction side of the secondary-side compressor 21 in the cascade unit 2 are connected via the first utilization pipe 57*c*, the first connecting tube 15*c*, the junction pipe 62*c*, the second branch pipe 64*c*, and the secondary-side second connection pipe 9. The utilization-side heat exchangers 52*a* and 52*b* in the utilization units 3*a* and 3*b* and the discharge side of the secondary-side compressor 21 in the cascade unit 2 are connected via the discharge flow path 24, the first pipe 28, the secondary-side first connection pipe 8, the first branch pipes 63*a* and 63*b*, the junction pipes 62*a* and 62*b*, the first connecting tubes 15*a* and 15*b*, and the first utilization pipes 57*a* and 57*b*. The secondary-side subcooling expansion valve 48*a* and the bypass expansion valve 46*a* are controlled into the closed state. In the utilization units 3*a*, 3*b*, and 3*c*, the opening degrees of the utilization-side expansion valves 51*a*, 51*b*, and 51*c* are adjusted.

In the heating main operation, the secondary-side refrigerant circuit 10 controls capacity, for example, by controlling the frequency of the secondary-side compressor 21 so as to process a load in a heat exchanger functioning as a radiator for the secondary-side refrigerant among the utilization-side heat exchangers 52*a*, 52*b*, and 52*c*. As a result, in the heating main operation, control is performed such that the secondary-side refrigerant discharged from the secondary-side compressor 21 can be in the critical state exceeding the critical pressure. The primary-side refrigerant circuit 5*a* controls capacity, for example, by controlling the frequency of the primary-side compressor 71 such that condensation temperature of the primary-side refrigerant in the primary-side flow path 35*b* of the cascade heat exchanger 35 becomes predetermined primary-side condensation target temperature.

The opening degree of the first electric component expansion valve 17*a* provided in the first electric component cooling flow path 17 is adjusted so as to be in the fully opened state or a predetermined opening degree. The second electric component expansion valve 18*a* provided in the second electric component cooling flow path 18 is adjusted to have a predetermined opening degree with which the secondary-side refrigerant passing through the second electric component expansion valve 18*a* can be decompressed. The valve opening degree of the second electric component expansion valve 18*a* may be controlled to satisfy such a condition that the secondary-side refrigerant after passing through the second cooling portion 11*b* has a predetermined degree of superheating or more, for example.

In such a secondary-side refrigerant circuit 10, the high-pressure secondary-side refrigerant compressed and discharged by the secondary-side compressor 21 is sent to the secondary-side first connection pipe 8 through the second switching valve 22*b* of the secondary-side switching mechanism 22, the first pipe 28, and the first shutoff valve 32.

Then, the high-pressure refrigerant sent to the secondary-side first connection pipe 8 is branched into two portions to be sent to the first branch pipes 63*a* and 63*b* of the first branch unit 6*a* and the second branch unit 6*b* connected to the first utilization unit 3*a* and the second utilization unit 3*b* in operation. The high-pressure refrigerant sent to the first branch pipes 63*a* and 63*b* is sent to the utilization-side heat exchangers 52*a* and 52*b* in the first utilization unit 3*a* and the second utilization unit 3*b* via the first control valves 66*a* and 66*b*, the junction pipes 62*a* and 62*b*, and the first connecting tubes 15*a* and 15*b*.

Then, the high-pressure refrigerant sent to the utilization-side heat exchangers 52*a* and 52*b* exchanges heat with indoor air supplied by the indoor fans 53*a* and 53*b* in the utilization-side heat exchangers 52*a* and 52*b*. The refrigerant flowing in the utilization-side heat exchangers 52*a* and 52*b* thus radiates heat. Indoor air is heated and is supplied into the indoor space. The indoor space is thus heated. The refrigerant having radiated heat in the utilization-side heat exchangers 52*a* and 52*b* flows in the second utilization pipes 56*a* and 56*b*, and passes the utilization-side expansion valves 51*a* and 51*b* whose opening degrees are adjusted. The secondary-side refrigerant having passed through the utilization-side expansion valves 51*a* and 51*b* has the critical pressure or less. Thereafter, the refrigerant having flowed through the second connecting tubes 16*a* and 16*b* is sent to the secondary-side third connection pipe 7 via the third branch pipes 61*a* and 61*b* of the branch units 6*a* and 6*b*.

Then, a part of the refrigerant sent to the secondary-side third connection pipe 7 is sent to the third branch pipe 61*c* of the branch unit 6*c*, and the remaining flows toward the third shutoff valve 31.

Then, the refrigerant sent to the third branch pipe 61*c* flows in the second utilization pipe 56*c* of the utilization unit 3*c* via the second connecting tube 16*c*, and is sent to the utilization-side expansion valve 51*c*.

Then, the refrigerant having passed the utilization-side expansion valve 51*c* whose opening degree is adjusted exchanges heat with indoor air supplied by the indoor fan 53*c* in the utilization-side heat exchanger 52*c*. The refrigerant flowing in the utilization-side heat exchanger 52*c* is thus evaporated into a low-pressure gas refrigerant. Indoor air is cooled and is supplied into the indoor space. The indoor space is thus cooled. The low-pressure gas refrigerant evaporated in the utilization-side heat exchanger 52*c* passes through the first utilization pipe 57*c* and the first connecting tube 15*c* to be sent to the junction pipe 62*c*.

Then, the low-pressure gas refrigerant sent to the junction pipe 62*c* is sent to the secondary-side second connection pipe 9 via the second control valve 67*c* and the second branch pipe 64*c*.

Then, the low-pressure gas refrigerant sent to the secondary-side second connection pipe 9 is returned to the suction side of the secondary-side compressor 21 via the second shutoff valve 33, the second pipe 29, the suction flow path 23, and the secondary-side accumulator 30.

Most of the refrigerant having flowed toward the third shutoff valve 31 is sent to the cascade expansion valve 36, and a remaining part of the refrigerant branches from the portion Z toward the first electric component cooling flow path 17 and flows. The refrigerant flowing through the first electric component cooling flow path 17 and not in the critical state passes through the first cooling portion 11*a* after passing through the first electric component expansion valve 17*a*, and cools the first electric component 91 of the cascade-side control unit 20 at that time. The refrigerant that has branched and flowed from the portion Y of the first electric component cooling flow path 17 to the second electric component cooling flow path 18 is decompressed when passing through the second electric component expansion valve 18*a*, becomes a refrigerant having a lower temperature, and is sent to the second cooling portion 11*b*. The refrigerant passing through the second cooling portion 11*b* cools the space S2 in which the second electric component 92 and the first electric component 91 of the cascade-side control unit 20 are provided. The refrigerant sent to the cascade expansion valve 36 passes through the cascade expansion valve 36 controlled in opening degree, and then exchanges heat with the primary-side refrigerant flowing in the primary-side flow path 35*b* in the secondary-side flow path 35*a* of the cascade heat exchanger 35. As a result, the refrigerant flowing in the secondary-side flow path 35*a* of the cascade heat exchanger 35 is evaporated into a low-pressure gas refrigerant, and is sent to the first switching valve 22*a* of the secondary-side switching mechanism 22. The low-pressure gas refrigerant sent to the first switching valve 22*a* of the secondary-side switching mechanism 22 joins the low-pressure gas refrigerant evaporated in the utilization-side heat exchanger 52*c* in the suction flow path 23. The refrigerant thus joined is returned to the suction side of the secondary-side compressor 21 via the secondary-side accumulator 30.

Behavior during the heating main operation is executed in this manner.

(10) Connection Configuration Between Primary-Side Unit and Cascade Unit

FIG. 7 is a schematic outer appearance view illustrating connection between the primary-side unit 5 and the cascade unit 2.

The primary-side unit 5 includes the primary-side casing 5*x* having a plurality of surfaces and a substantially rectangular parallelepiped shape. The primary-side casing 5*x* internally accommodates, as a part of the primary-side refrigerant circuit 5*a*, the primary-side compressor 71, the primary-side switching mechanism 72, the primary-side heat exchanger 74, the primary-side first expansion valve 76, the primary-side subcooling heat exchanger 103, the primary-side subcooling circuit 104, the primary-side subcooling expansion valve 104*a*, the first liquid shutoff valve 108, the first gas shutoff valve 109, and the primary-side accumulator 105. The primary-side first connection pipe 111 and the primary-side second connection pipe 112 as a part of the primary-side refrigerant circuit 5*a* extend from the primary-side casing 5*x*.

The cascade unit 2 includes the cascade casing 2*x* having a substantially rectangular parallelepiped shape. The cascade casing 2*x* accommodates a part of the secondary-side refrigerant circuit 10 and a part of the primary-side refrigerant circuit 5*a*. A part of the secondary-side refrigerant circuit 10 accommodated in the cascade casing 2*x* includes the cascade circuit 12 including the secondary-side compressor 21, the secondary-side switching mechanism 22, the first pipe 28, the second pipe 29, the suction flow path 23, the discharge flow path 24, the third pipe 25, the fourth pipe 26, the fifth pipe 27, the secondary-side flow path 35*a* of the cascade heat exchanger 35, the cascade expansion valve 36, the third shutoff valve 31, the first shutoff valve 32, the second shutoff valve 33, the secondary-side accumulator 30, the oil separator 34, the oil return circuit 40, the secondary-side receiver 45, the bypass circuit 46, the bypass expansion valve 46*a*, the secondary-side subcooling heat exchanger 47, the secondary-side subcooling circuit 48, and the secondary-side subcooling expansion valve 48*a*. A part of the primary-side refrigerant circuit 5*a* accommodated in the cascade casing 2*x* includes the second liquid shutoff valve 106, the second refrigerant pipe 114, the primary-side second expansion valve 102, the primary-side flow path 35*b* of the cascade heat exchanger 35, the first refrigerant pipe 113, and the second gas shutoff valve 107. The secondary-side third connection pipe 7, the secondary-side first connection pipe 8, and the secondary-side second connection pipe 9 as a part of the secondary-side refrigerant circuit 10 extend from the cascade casing 2*x*. The primary-side first connection pipe 111 and the primary-side second connection pipe 112 as a part of the primary-side refrigerant circuit 5*a* extend from the cascade casing 2*x*.

The cascade casing 2*x* has a plurality of surfaces including a top surface 120*a*, a right side surface 120*b*, a front surface 120*c*, a left side surface 120*d*, a back surface 120*e*, and a bottom surface 120*f*. Among the plurality of surfaces, the front surface 120*c* is provided with a connection opening 120*x*. The primary-side first connection pipe 111, the primary-side second connection pipe 112, the secondary-side third connection pipe 7, the secondary-side first connection pipe 8, and the secondary-side second connection pipe 9 pass through the connection opening 120*x*. The cascade heat exchanger 35 is placed on the bottom surface 120*f*.

The second liquid shutoff valve 106 to which the primary-side first connection pipe 111 is connected and the second gas shutoff valve 107 to which the primary-side second connection pipe 112 is connected are located in the connection opening 120*x* of the cascade casing 2*x*. Similarly, the third shutoff valve 31 to which the secondary-side third connection pipe 7 is connected, the first shutoff valve 32 to which the secondary-side first connection pipe 8 is connected, and the second shutoff valve 33 to which the secondary-side second connection pipe 9 is connected are located inside the connection opening 120*x* in the cascade casing 2*x*.

(11) Cascade-Side Control Unit

As shown in FIG. 7, the cascade-side control unit 20 is provided near an upper front side in the cascade casing 2*x* of the cascade unit 2 so as to face the back side of the front surface 120*c*.

Figure 8:
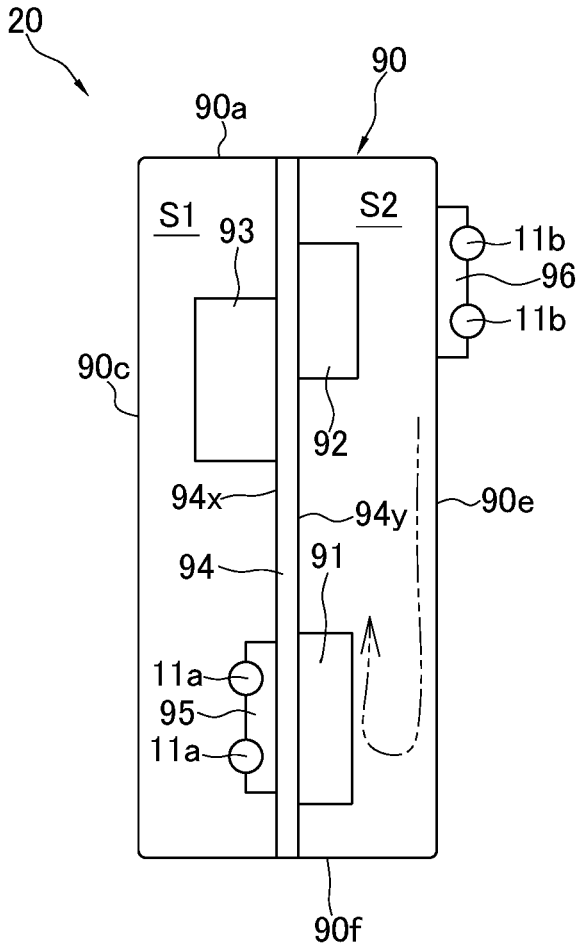
FIG. 8 is a schematic configuration diagram of a cascade-side control unit as viewed from a side.

FIG. 8 is a schematic configuration diagram of the cascade-side control unit 20 as viewed from a side.

The cascade-side control unit 20 includes an electric component casing 90, an electric component attachment plate 94, the first electric component 91, the second electric component 92, a third electric component 93, and the like.

The electric component casing 90 has a substantially rectangular parallelepiped shape including a top surface 90*a*, a bottom surface 90*f*, a front surface 90*c*, a back surface 90*e*, and a left side surface and a right side surface (not shown), and is formed by sheet metal. The electric component casing 90 internally accommodates the electric component attachment plate 94, the first electric component 91, the second electric component 92, the third electric component 93, a heat transfer member 95, and the first cooling portion 11*a*. On the back surface of the electric component casing 90, a second cooling portion 11*b* extending so as to be folded back in a left-right direction is fixed from behind via a heat transfer member 96 formed by metal.

The electric component attachment plate 94 is provided so as to partition the inside of the electric component casing 90 into a front space S1 and a rear space S2 in an orientation in which a thickness direction is a front-rear direction. The electric component attachment plate 94 has a front surface 94*x* to which the third electric component 93 is attached and a back surface 94*y* to which the first electric component 91 and the second electric component 92 are attached.

The first electric component 91, the second electric component 92, and the third electric component 93 are electric parts constituting the cascade-side control unit 20.

The first electric component 91 is an electric component for an inverter of the secondary-side compressor 21 and is an intelligent power module (IPM) which is a heat-generating part. The first electric component 91 is provided near a lower part of the back surface 94*y* of the electric component attachment plate 94.

The second electric component 92 is an electric component including a noise filter which is a heat-generating part. The second electric component 92 is provided near an upper part of the back surface 94*y* of the electric component attachment plate 94 and above the first electric component 91.

The third electric component 93 is an electric component including a main control board. The third electric component 93 is provided near an upper part of the front surface 94*x* of the electric component attachment plate 94 and above the heat transfer member 95.

The first cooling portion 11*a* extends so as to be folded back in the left-right direction in front view. The first cooling portion 11*a* is fixed to a portion near the lower part of the front surface 94*x* of the electric component attachment plate 94 and below the third electric component 93 via the heat transfer member 95 formed by metal. The first cooling portion 11*a*, the heat transfer member 95, and the first electric component 91 are disposed so as to have an overlapping portion in front view.

In the above configuration, a cooling energy of the secondary-side refrigerant flowing through the first cooling portion 11*a* is transferred to the first electric component 91 via the heat transfer member 95, and a temperature rise of the first electric component 91 can be suppressed.

A cooling energy of the secondary-side refrigerant flowing through the second cooling portion 11*b* causes circulation of air in the space S2 on the back side of the electric component attachment plate 94 in an internal space of the electric component casing 90. Specifically, air near an upper part on the back side of the electric component casing 90 is cooled by the cooling energy from the second cooling portion 11*b*, and becomes cold air and descends downward. Then, the air that has descended downward reaches the first electric component 91 and is heated by heat generated from the first electric component 91 to rise. The downward air flow and the upward air flow form a circulating flow of air as indicated by a two-dot chain line arrow in FIG. 8. It is therefore possible to suppress a temperature rise of the first electric component 91 and the second electric component 92 provided in the space S2 on the back side of the electric component attachment plate 94 in the internal space of the electric component casing 90.

Since the temperature of the secondary-side refrigerant flowing through the second cooling portion 11*b* is reduced by the second electric component expansion valve 18*a*, the temperature of the secondary-side refrigerant flowing through the second cooling portion 11*b* is lower than the temperature of the secondary-side refrigerant flowing through the first cooling portion 11*a*, which may cause dew condensation on a back surface portion of the electric component casing 90. However, since none of the first electric component 91, the second electric component 92, and the third electric component 93 is in contact with the back surface portion of the electric component casing 90, dew condensation water is prevented from reaching the first electric component 91, the second electric component 92, and the third electric component 93. Since the secondary-side refrigerant flowing through the first cooling portion 11*a* is the refrigerant before being decompressed by the second electric component expansion valve 18*a*, a decrease in temperature is suppressed. Therefore, generation of dew condensation in the first cooling portion 11*a* is suppressed.

(12) Characteristics of Embodiment

In the refrigeration cycle apparatus 1 according to the present embodiment, the cascade unit 2 is provided with the cascade heat exchanger 35 that exchanges heat between the primary-side refrigerant flowing through the primary-side refrigerant circuit 5*a* and the secondary-side refrigerant flowing through the secondary-side refrigerant circuit 10, and is not provided with a heat exchanger that exchanges heat with air. Accordingly, the cascade unit 2 is not provided with a fan that supplies an air flow to the heat exchanger. Therefore, in order to cool the first electric component 91 and the second electric component 92 which are heat-generating parts in the cascade-side control unit 20, an air flow toward the heat exchanger cannot be used. However, in the refrigeration cycle apparatus 1 according to the present embodiment, the first electric component 91 and the second electric component 92 can be cooled by causing the secondary-side refrigerant flowing through the secondary-side refrigerant circuit 10 to flow in the first cooling portion 11*a* and the second cooling portion 11*b* attached to the cascade-side control unit 20. The first electric component 91 and the second electric component 92 provided in the electric component casing 90 of the cascade-side control unit 20 can be cooled by the first cooling portion 11*a* and the second cooling portion 11*b*, and there is no need to supply an air flow into the electric component casing 90. Therefore, a structure with high sealability can be adopted as the electric component casing 90. As a result, dust and the like are prevented from entering the electric component casing 90, and reliability of the electric components can be enhanced.

In the secondary-side refrigerant circuit 10, a carbon dioxide refrigerant that can be in the supercritical state where the behavior becomes unstable is used as the refrigerant. However, the carbon dioxide refrigerant flowing through the cascade heat exchanger 35 does not exchange heat with outdoor air whose temperature naturally changes due to weather change, but exchanges heat with the primary-side refrigerant flowing in the primary-side refrigerant circuit 5*a*. When the cascade heat exchanger 35 functions as a radiator for the secondary-side refrigerant, the temperature and flow rate of the primary-side refrigerant flowing through the cascade heat exchanger 35 are controlled. As a result, it is possible to prevent the secondary-side refrigerant, which is sent to the first cooling portion 11*a* and the second cooling portion 11*b* after passing through the cascade heat exchanger 35, from being in the supercritical state, and it is possible to avoid a situation in which the temperature of the secondary-side refrigerant is likely to change greatly. Therefore, the temperature of the secondary-side refrigerant flowing through the first cooling portion 11*a* and the second cooling portion 11*b* can be stabilized, and the temperature of the first electric component 91 and the second electric component 92 can be prevented from being abnormally increased. When the cascade heat exchanger 35 functions as a radiator for the secondary-side refrigerant, the pressure of the secondary-side refrigerant to be sent to the first cooling portion 11*a* and the second cooling portion 11*b* can be made equal to or lower than the critical pressure by performing control to increase the valve opening degree of the cascade expansion valve 36. This configuration can also stabilize the temperature of the secondary-side refrigerant flowing through the first cooling portion 11*a* and the second cooling portion 11*b*.

In the refrigeration cycle apparatus 1 according to the present embodiment, the first cooling portion 11*a* and the second cooling portion 11*b* through which the secondary-side refrigerant having a temperature lower than the temperature of the first cooling portion 11*a* flows can be used to cool the plurality of electric components included in the cascade-side control unit 20 in different temperature ranges. Here, the first cooling portion 11*a* is in thermal contact with the first electric component 91 via the heat transfer member 95, so that the first electric component 91 can be efficiently cooled without interposing an air space. In addition, the first cooling portion 11*a* is different from the second cooling portion 11*b* through which the low-temperature refrigerant decompressed by the second electric component expansion valve 18*a* flows, and the refrigerant having a relatively high temperature flows through the first cooling portion 11*a*. Thus, generation of dew condensation is suppressed in the first cooling portion 11*a*. Therefore, in the first cooling portion 11*a*, it is possible to efficiently cool the first electric component 91 and to prevent the first electric component 91 from getting wet with dew condensation water. On the other hand, since the refrigerant having a low temperature and decompressed by the second electric component expansion valve 18*a* flows through the second cooling portion 11*b*, the refrigerant can sufficiently cool the space S2 on the back side of the electric component casing 90. As a result, although the second cooling portion 11*b* and the second electric component 92 are not disposed in direct contact with each other, the second electric component 92 can be sufficiently cooled. Even if dew condensation water is generated in the second cooling portion 11*b*, there is no electric component in direct contact with the second cooling portion 11*b*, and no electric component is disposed below the second cooling portion 11*b*. It is therefore possible to prevent the electric components from getting wet with the dew condensation water.

In the refrigeration cycle apparatus 1 according to the present embodiment, the primary-side compressor 71 and the like can control capacity in the primary-side refrigerant circuit 5*a*. Therefore, even if the temperature of the outdoor air changes, the capacity is controlled in the primary-side refrigerant circuit 5*a*, so that it is easy to secure an amount of heat exchange required in the secondary-side flow path 35*a* of the cascade heat exchanger 35 of the secondary-side refrigerant circuit 10. As a result, even if the temperature of the outdoor air changes, the amount of heat exchange in the secondary-side flow path 35*a* of the cascade heat exchanger 35 can be controlled so as to cope with load processing required in the secondary-side refrigerant circuit 10.

In the refrigeration cycle apparatus 1 according to the present embodiment, since the binary refrigeration cycle is adopted, the secondary-side refrigerant circuit 10 can provide more sufficient capacity than in a single refrigerant cycle. In the refrigeration cycle apparatus 1 according to the present embodiment adopting the binary refrigeration cycle, since heat can be received from the primary-side refrigerant circuit 5*a*, the capacity of the secondary-side compressor 21 can be reduced more than in the single refrigeration cycle. Therefore, a heat generation amount can be suppressed to be small even in the first electric component 91 which is the IPM for the inverter of the secondary-side compressor 21. As a result, abnormal heat generation can be sufficiently suppressed only by cooling by the first cooling portion 11*a*.

(13) Other Embodiments (13-1) Another Embodiment A

In the above embodiment, a case has been described as an example where the first electric component 91 and the second electric component 92 are cooled by causing the secondary-side refrigerant flowing through the secondary-side refrigerant circuit 10 to flow into the first cooling portion 11*a* and the second cooling portion 11*b*.

Figure 9:
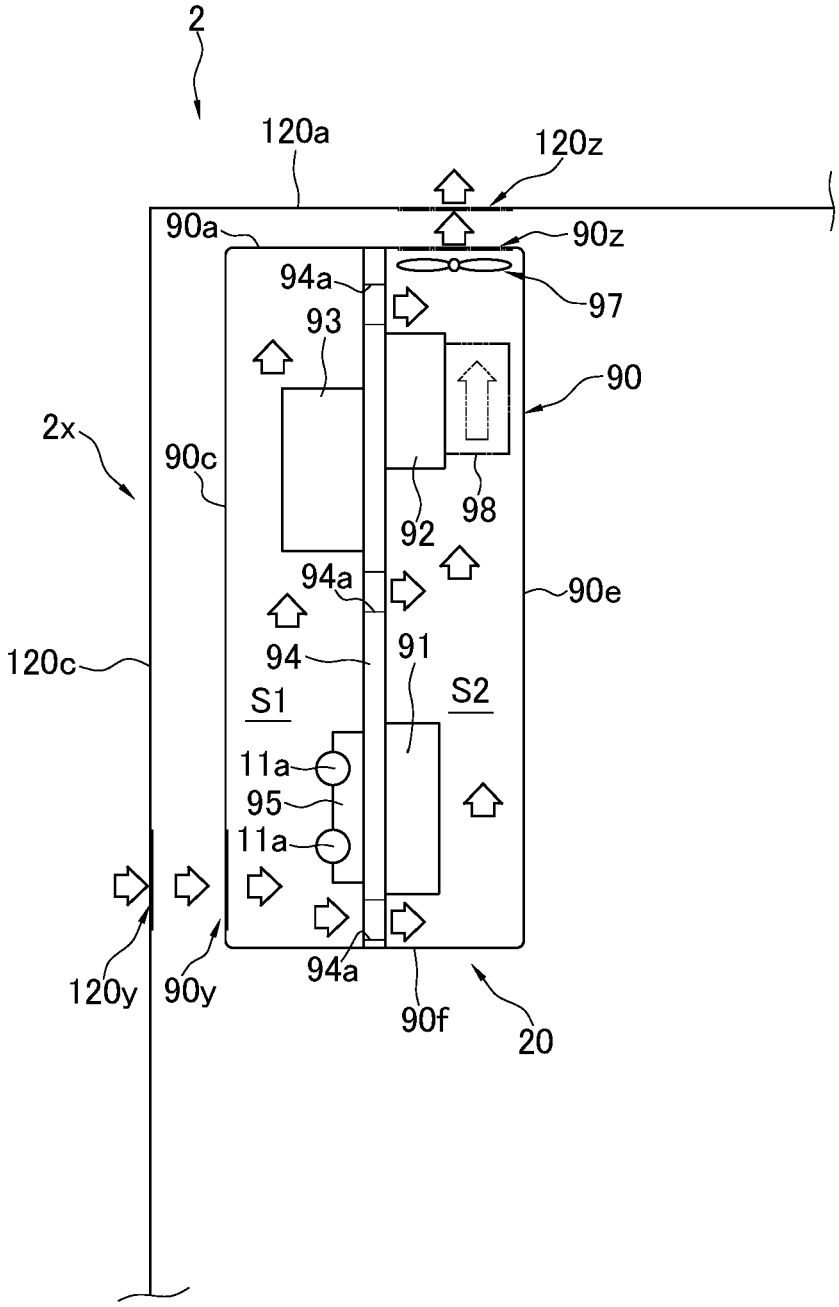
FIG. 9 is a schematic configuration diagram of a cascade-side control unit according to another embodiment A and its periphery as viewed from a side.

However, for example, as shown in FIG. 9, the first electric component 91 may be cooled by causing the secondary-side refrigerant flowing through the secondary-side refrigerant circuit 10 to flow into the first cooling portion 11*a*, and the first electric component 91, the second electric component 92, and the third electric component may be cooled by using an electric component fan 97. The electric component fan 97 is controlled to be driven by the cascade-side control unit 20 during each of the cooling operation, the heating operation, the cooling main operation, and the heating main operation. In this case, the second electric component cooling flow path 18 provided with the second cooling portion 11*b* and the second electric component expansion valve 18*a* in the above embodiment can be omitted.

In another embodiment A, the electric component casing 90 of the cascade-side control unit 20 is provided with a top surface opening 90*z* that is opened to allow air to flow in the up-down direction in an upper part of the space S2 on the back side in the top surface 90*a*. The electric component casing 90 is also provided with a front surface opening 90*y* that is opened to allow air to flow in the front-rear direction in a lower part of the space S1 on the front side which is a place far from the top surface opening 90*z* in the front surface 90*c*. The electric component casing 90 has no opening in the back surface 90*e* and the bottom surface 90*f*. Therefore, air near the secondary-side compressor 21 hardly flows into the electric component casing 90.

The cascade casing 2*x* of the cascade unit 2 is provided with a top surface opening 120*z* that is opened to allow air to flow in the up-down direction in the top surface 120*a*. The top surface opening 120*z* of the cascade casing 2*x* and the top surface opening 90*z* of the electric component casing 90 are disposed so as to overlap each other in plan view. The cascade casing 2*x* is provided with a front surface opening 120*y* that is opened to allow air to flow in the front-rear direction in the front surface 120*c*. The front surface opening 120*y* of the cascade casing 2*x* and the front surface opening 90*y* of the electric component casing 90 are disposed so as to overlap each other in front view.

The electric component attachment plate 94 is provided with ventilation openings 94*a* that are opened in the front-rear thickness direction in a lower part, near a center, and in an upper part.

The second electric component 92 of the cascade-side control unit 20 is provided with a heat sink 98 constituting a heat radiation fin for promoting heat release from the electric component. The heat sink 98 is configured so that a plurality of heat radiation fins extends toward the back side of the second electric component 92. The heat radiation fins are arranged side by side at predetermined intervals in the left-right direction so that the thickness direction is in the left-right direction.

The cascade-side control unit 20 is provided with the electric component fan 97 at a position in an upper part of the space S2 on the back side in the electric component casing 90 and facing the top surface opening 90*z*. The electric component fan 97 is disposed closer to the top surface opening 90*z* than the electric components disposed in the electric component casing 90. The electric component fan 97 is driven to form an air flow in the up-down direction.

As a result, when the electric component fan 97 is driven, an air flow for cooling the first electric component 91, the second electric component 92, and the third electric component 93 is generated in the electric component casing 90 as indicated by arrows in FIG. 9. Specifically, the outdoor air is taken into the electric component casing 90 by sequentially passing through the front surface opening 120*y* of the cascade casing 2*x* and the front surface opening 90*y* of the electric component casing 90. In the electric component casing 90, the air passes through the ventilation openings 94*a* of the electric component attachment plate 94 while ascending in the space S1 on the front side, and is sent to the space S2 on the back side. The air having ascended in the space S1 on the front side passes around the third electric component 93 to cool the third electric component 93. The air having reached the space S2 on the back side passes around the first electric component 91 to cool the first electric component 91 and ascend in the space S2. The air flow ascending in the space S2 passes through the heat sink 98 to efficiently cool the second electric component 92. As in the above embodiment, the first electric component 91 is also cooled by the first cooling portion 11*a*.

The air that has ascended in the space S2 on the back side as described above passes through the top surface opening 90*z* of the electric component casing 90 and the top surface opening 120*z* of the cascade casing 2*x* in that order by the electric component fan 97 and is discharged to outdoors.

In the above configuration, the electric components of the cascade-side control unit 20 can be also sufficiently cooled.

(13-2) Another Embodiment B

In the another embodiment A, description has been given by exemplifying a case in which the electric component fan 97 is disposed in the electric component casing 90, the top surface opening 120*z* of the cascade casing 2*x* and the top surface opening 90*z* of the electric component casing 90 are disposed so as to overlap each other in plan view, and the front surface opening 120*y* of the cascade casing 2*x* and the front surface opening 90*y* of the electric component casing 90 are disposed so as to overlap each other in front view.

Figure 10:
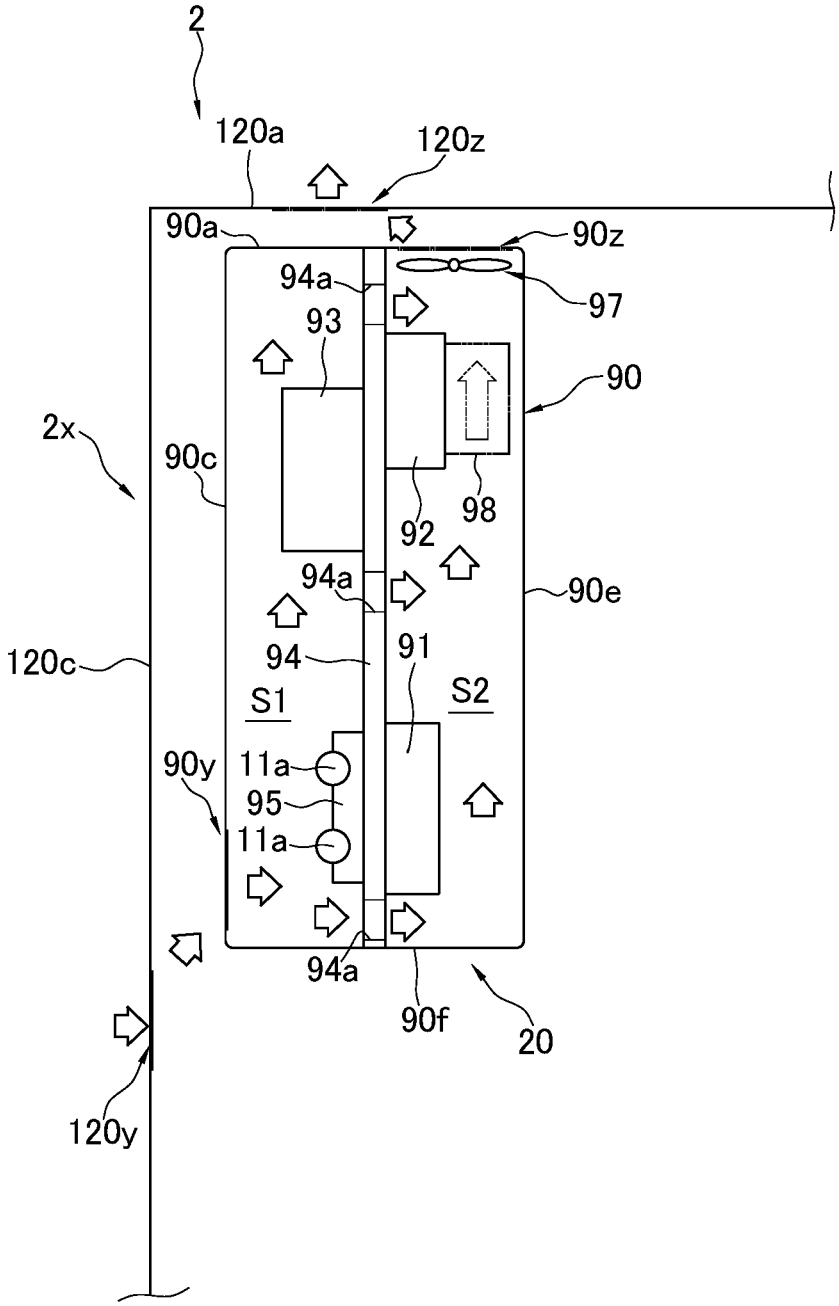
FIG. 10 is a schematic configuration diagram of a cascade-side control unit according to another embodiment B and its periphery as viewed from a side.

However, for example, as shown in FIG. 10, the top surface opening 90*z* of the electric component casing 90 may be disposed so as to have a portion not overlapping with the top surface opening 120*z* of the cascade casing 2*x* in plan view, or may be disposed so as not to overlap with the top surface opening 120*z* of the cascade casing 2*x* at all. Furthermore, the front surface opening 90*y* of the electric component casing 90 may be disposed so as to have a portion not overlapping the front surface opening 120*y* of the cascade casing 2*x* when viewed in front view or from a periphery. In this case, for example, an upper end of the front surface opening 90*y* of the electric component casing 90 is preferably disposed at a position higher than an upper end of the front surface opening 120*y* of the cascade casing 2*x*, and a lower end of the front surface opening 90*y* of the electric component casing 90 is more preferably disposed at a position higher than the upper end of the front surface opening 120*y* of the cascade casing 2*x*.

By adopting such a water shielding structure, rainwater is prevented from reaching the inside of the electric component casing 90 even when the cascade unit 2 is disposed outdoors.

(13-3) Another Embodiment C

In the another embodiments A and B, description has been given by exemplifying a structure in which the electric component fan 97 is disposed in the electric component casing 90, the first electric component 91 is provided on one surface of the electric component attachment plate 94, and the second electric component 92 and the third electric component 93 are provided on the other surface of the electric component attachment plate 94 in the cascade-side control unit 20.

Figure 11:
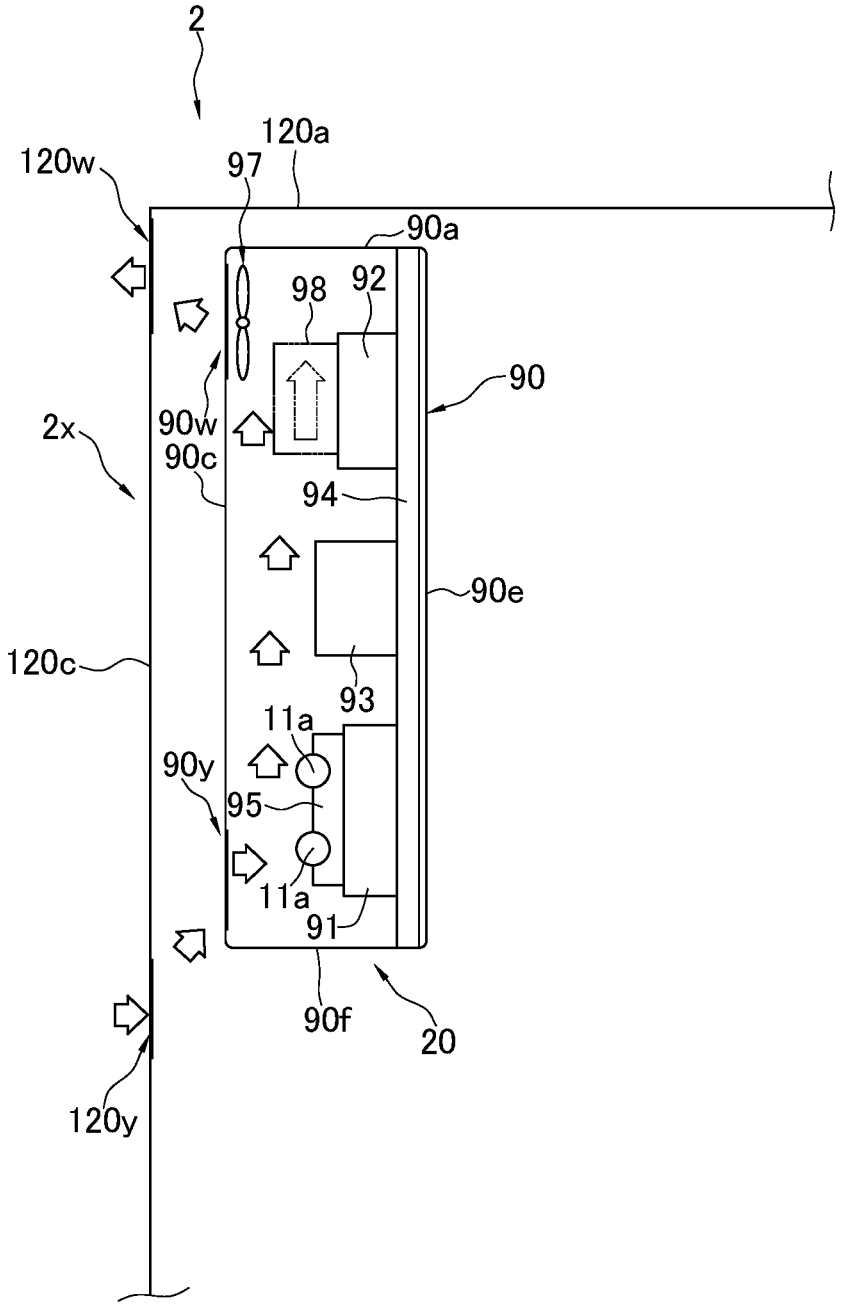
FIG. 11 is a schematic configuration diagram of a cascade-side control unit according to another embodiment C and its periphery as viewed from a side.

However, for example, as shown in FIG. 11, the cascade-side control unit 20 may have a structure in which all the electric components, namely, the first electric component 91, the second electric component 92, and the third electric component 93 are provided on one side surface of the electric component attachment plate 94.

As in the another embodiment B, the front surface opening 90*y* of the electric component casing 90 may be disposed so as to have a portion not overlapping the front surface opening 120*y* of the cascade casing 2*x* when viewed in front view or from the periphery. In this case, for example, an upper end of the front surface opening 90*y* of the electric component casing 90 is preferably disposed at a position higher than an upper end of the front surface opening 120*y* of the cascade casing 2*x*, and a lower end of the front surface opening 90*y* of the electric component casing 90 is more preferably disposed at a position higher than the upper end of the front surface opening 120*y* of the cascade casing 2*x*. The front surface opening 90*y* of the electric component casing 90 is preferably located below a center of the electric component casing 90 in a height direction.

The electric component casing 90 may have an exhaust opening 90*w* for guiding an air flow exhausted from the electric component fan 97 to the outside of the electric component casing 90. The exhaust opening 90*w* is preferably provided on the front surface of the electric component casing 90 and at a position away from the front surface opening 90*y*. When the front surface opening 90*y* is located below, the exhaust opening 90*w* is preferably located above the center in the height direction of the electric component casing 90.

Similarly, the cascade casing 2*x* may have an exhaust opening 120*w* for guiding an air flow exhausted from the electric component fan 97 to outdoors. The exhaust opening 120*w* is preferably provided on the front surface of the cascade casing 2*x* and at a position away from the front surface opening 120*y*. The exhaust opening 120*w* of the cascade casing 2*x* may have a portion overlapping with the exhaust opening 90*w* of the electric component casing 90 in front view.

As a result, in the air flow formed by the electric component fan 97, it is possible to suppress a short circuit in which the air exhausted to outdoors from the exhaust opening 120*w* of the cascade casing 2*x* is directly taken into the front surface opening 120*y* of the cascade casing 2*x*.

(13-4) Another Embodiment D

In the another embodiments A, B, and C, description has been given by exemplifying a case in which the electric component fan 97 is disposed in the electric component casing 90 to actively form an air flow in the electric component casing 90.

However, the electric component fan 97 in the another embodiments A, B, and C may be omitted, for example, when heat in a space in the electric component casing 90 can be exhausted from the top surface opening 90*z* or the like by natural convection even if there is no source of forming an air flow, such as the electric component fan 97.

(13-5) Another Embodiment E

In the above embodiment, description has been given by exemplifying a case in which the second electric component cooling flow path 18 is a refrigerant flow path that connects the portion Y between the first cooling portion 11*a* and the first electric component expansion valve 17*a* on the first electric component cooling flow path 17 and the portion W at a halfway portion of the suction flow path 23.

Figure 12:
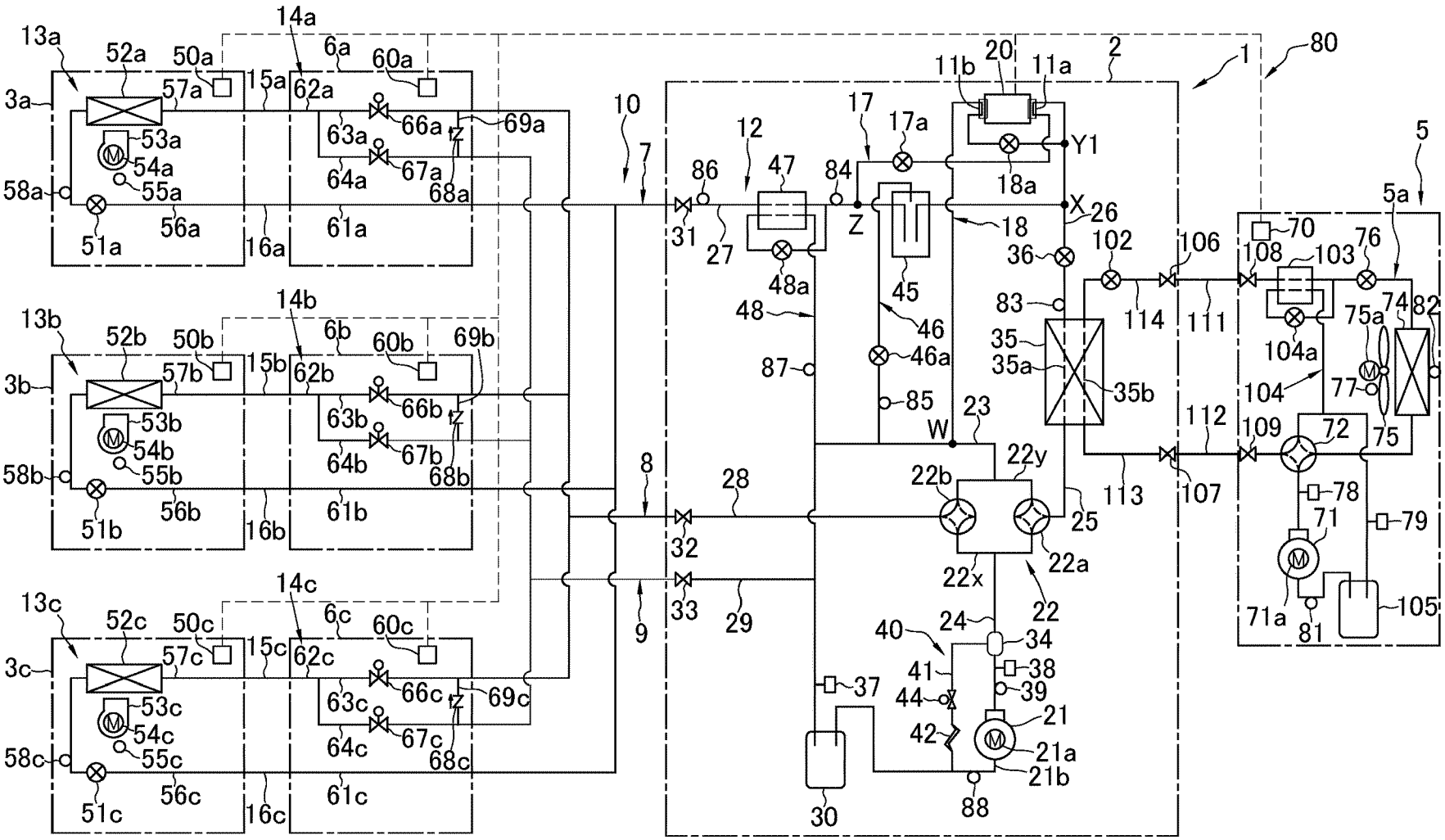
FIG. 12 is a schematic configuration diagram of a refrigeration cycle apparatus according to another embodiment E.

However, for example, as shown in FIG. 12, the second electric component cooling flow path 18 may be a refrigerant flow path that connects a portion Y1 between the portion X of the fourth pipe 26 between the cascade expansion valve 36 and the secondary-side receiver 45 and the first cooling portion 11*a* of the first electric component cooling flow path 17 and the portion W at a halfway portion of the suction flow path 23.

In this case, the second electric component expansion valve 18*a* can decompress not the refrigerant after the heat is radiated in the first cooling portion 11*a* but the refrigerant before the refrigerant is sent to the first cooling portion 11*a*. Accordingly, the electric components can be cooled in the second cooling portion 11*b* by using the sufficiently cooled refrigerant.

(13-6) Another Embodiment F

In the above embodiment, description has been given by exemplifying a case in which the second electric component cooling flow path 18 is a refrigerant flow path that connects the portion Y between the first cooling portion 11*a* and the first electric component expansion valve 17*a* on the first electric component cooling flow path 17 and the portion W at a halfway portion of the suction flow path 23.

Figure 13:
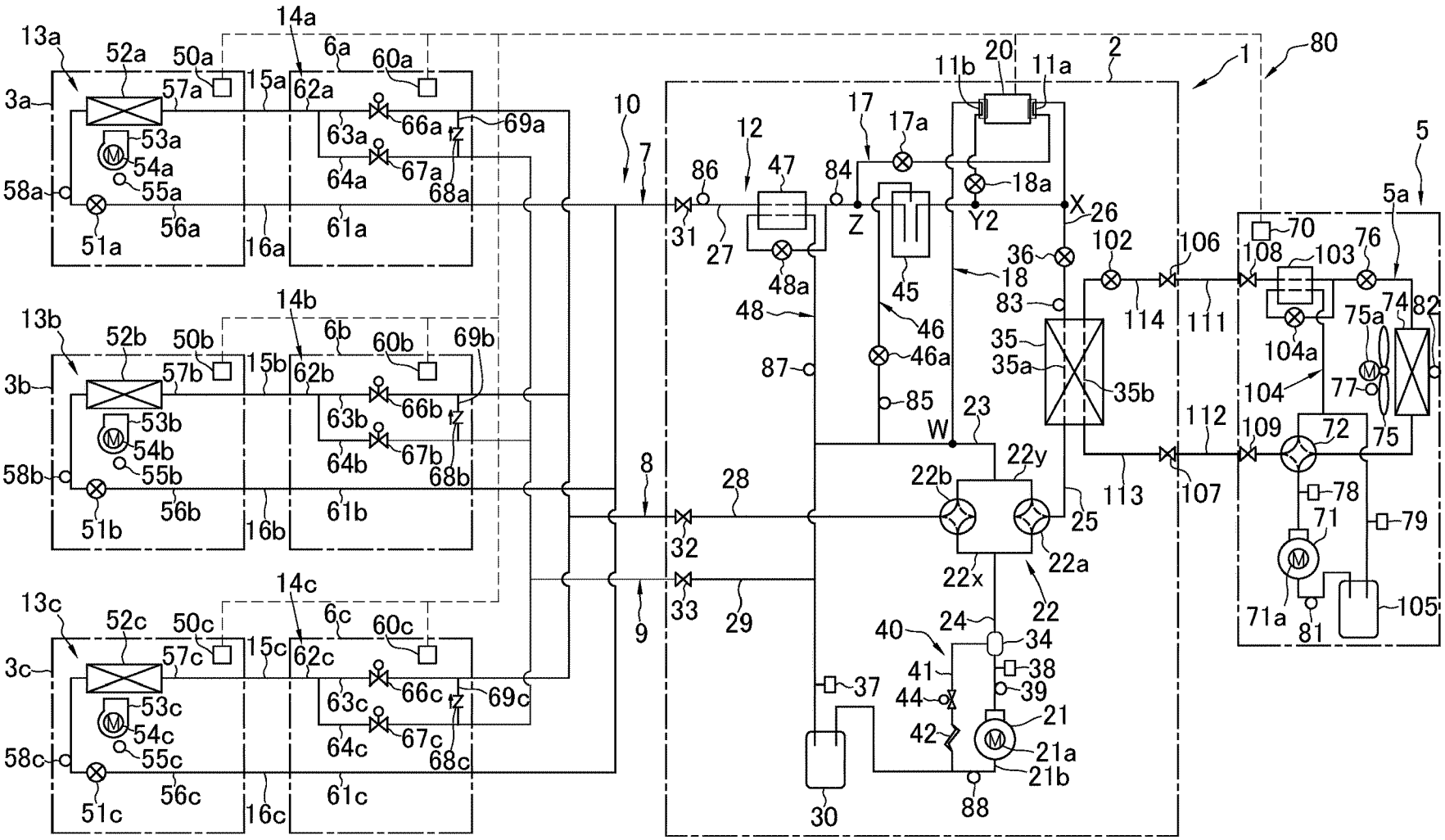
FIG. 13 is a schematic configuration diagram of a refrigeration cycle apparatus according to another embodiment F.

However, for example, as shown in FIG. 13, the second electric component cooling flow path 18 may be a refrigerant flow path that connects a portion Y2 between the portion X of the fourth pipe 26 between the cascade expansion valve 36 and the secondary-side receiver 45 and the secondary-side receiver 45 and the portion W at a halfway portion of the suction flow path 23.

In this case, as in the another embodiment E, the second electric component expansion valve 18*a* can decompress not the refrigerant after the heat is radiated in the first cooling portion 11*a* but the refrigerant before the refrigerant is sent to the first cooling portion 11*a*. Accordingly, the electric components can be cooled in the second cooling portion 11*b* by using the sufficiently cooled refrigerant.

(13-7) Another Embodiment G

In the above embodiment, description has been given by exemplifying a case in which the refrigeration cycle apparatus 1 in which one cascade unit 2 is connected to one primary-side unit 5.

Figure 14:
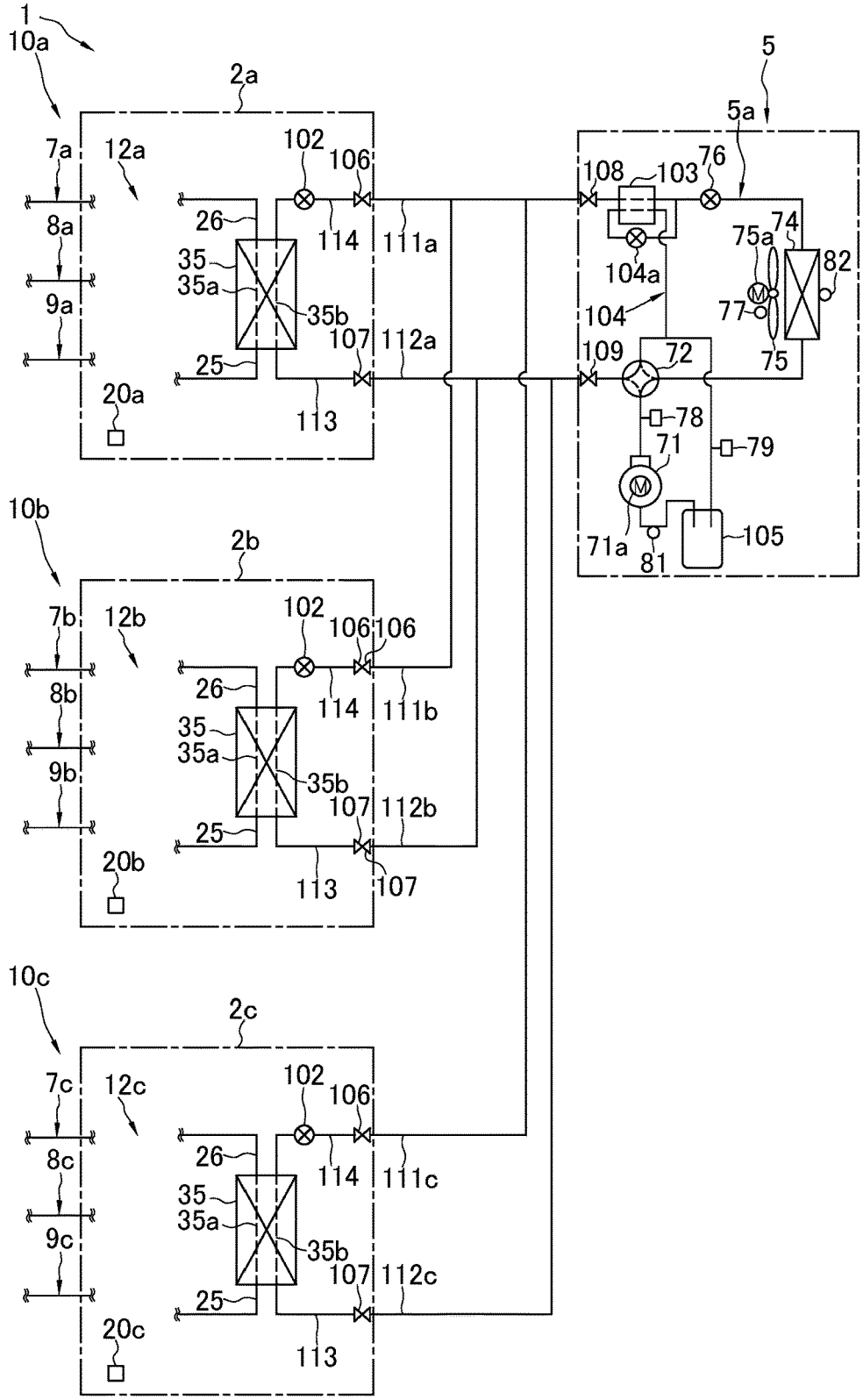
FIG. 14 is a schematic configuration diagram of a refrigeration cycle apparatus according to another embodiment G.

However, as shown in FIG. 14, for example, by connecting a first cascade unit 2*a*, a second cascade unit 2*b*, and a third cascade unit 2*c*, which are a plurality of cascade units, in parallel to one primary-side unit 5, the refrigeration cycle apparatus 1 may include a first secondary-side refrigerant circuit 10*a* including a first cascade circuit 12*a*, a second secondary-side refrigerant circuit 10*b* including a second cascade circuit 12*b*, and a third secondary-side refrigerant circuit 10*c* including a third cascade circuit 12*c*. Note that, in FIG. 14, an internal structure of each of the first cascade unit 2*a*, the second cascade unit 2*b*, and the third cascade unit 2*c* is similar to that of the cascade unit 2 according to the above embodiment, and thus only a part of each cascade unit is illustrated.

Although not shown, each of the first cascade unit 2*a*, the second cascade unit 2*b*, and the third cascade unit 2*c* is connected with the plurality of branch units 6*a*, 6*b*, and 6*c* and the plurality of utilization units 3*a*, 3*b*, and 3*c* as in the above embodiment. Specifically, the first cascade unit 2*a* is connected to a plurality of branch units and utilization units via a secondary-side third connection pipe 7*a*, a secondary-side first connection pipe 8*a*, and a secondary-side second connection pipe 9*a*. The second cascade unit 2*b* is connected, via a secondary-side third connection pipe 7*b*, a secondary-side first connection pipe 8*b*, and a secondary-side second connection pipe 9*b*, with a plurality of branch units and utilization units different from those connected with the first cascade unit 2*a*. The third cascade unit 2*c* is connected, via a secondary-side third connection pipe 7*c*, a secondary-side first connection pipe 8*c*, and a secondary-side second connection pipe 9*c*, with another plurality of branch units and utilization units different from those connected to the first cascade unit 2*a* and different from those connected to the second cascade unit 2*b*.

Here, the primary-side unit 5 and the first cascade unit 2*a* are connected via a primary-side first connection pipe 111*a* and a primary-side second connection pipe 112*a*. The primary-side unit 5 and the second cascade unit 2*b* are connected via a primary-side first connection pipe 111*b* branched from the primary-side first connection pipe 111*a* and a primary-side second connection pipe 112*b* branched from the primary-side second connection pipe 112*a*. The primary-side unit 5 and the third cascade unit 2*c* are connected via a primary-side first connection pipe 111*c* branched from the primary-side first connection pipe 111*a* and a primary-side second connection pipe 112*c* branched from the primary-side second connection pipe 112*a*.

Here, each of the first cascade unit 2*a*, the second cascade unit 2*b*, and the third cascade unit 2*c* includes a primary-side second expansion valve 102 whose opening degree is controlled by the first cascade unit 2*a*, the second cascade unit 2*b*, and the third cascade unit 2*c*. A first cascade-side control unit 20*a* included in the first cascade unit 2*a*, a second cascade-side control unit 20*b* included in the second cascade unit 2*b*, and a third cascade-side control unit 20*c* included in the third cascade unit 2*c* control the opening degree of the corresponding primary-side second expansion valve 102. As in the above embodiment, each of the first cascade-side control unit 20*a*, the second cascade-side control unit 20*b*, and the third cascade-side control unit 20*c* controls the valve opening degree of the corresponding primary-side second expansion valve 102 on the basis of conditions of the first cascade circuit 12*a*, the second cascade circuit 12*b*, and the third cascade circuit 12*c* controlled by the first cascade-side control unit 20*a*, the second cascade-side control unit 20*b*, and the third cascade-side control unit 20*c*. As a result, the primary-side refrigerant flowing through the primary-side refrigerant circuit 5*a* is controlled to have a flow rate of the primary-side refrigerant in the primary-side first connection pipe 111*a* and the primary-side second connection pipe 112*a*, a flow rate of the primary-side refrigerant in the primary-side first connection pipe 111*b* and the primary-side second connection pipe 112*b*, and a flow rate of the primary-side refrigerant in the primary-side first connection pipe 111*c* and the primary-side second connection pipe 112*c* so as to correspond to a difference in loads in the first secondary-side refrigerant circuit 10*a*, the second secondary-side refrigerant circuit 10*b*, and the third secondary-side refrigerant circuit 10*c*.

(13-8) Another Embodiment H

In the above embodiment, R32 or R410A is exemplified as the refrigerant used in the primary-side refrigerant circuit 5*a*, and carbon dioxide is exemplified as the refrigerant used in the secondary-side refrigerant circuit 10.

However, the refrigerant used in the primary-side refrigerant circuit 5*a* is not limited, and an HFC-32, an HFO refrigerant, a mixed refrigerant of the HFC-32 and the HFO refrigerant, carbon dioxide, ammonia, propane, or the like can be used.

Furthermore, instead of the primary-side refrigerant circuit 5*a* through which the refrigerant flows, a heat medium circuit through which a heat medium such as water or brine flows may be used. In this case, the heat medium circuit may include a heat source that functions as a heating source or a cooling source, and a pump for circulating the heat medium. In this case, the flow rate can be adjusted by the pump, and the amount of heat can be controlled by the heating source or the cooling source.

The refrigerant used in the secondary-side refrigerant circuit 10 is not limited, and an HFC-32, an HFO refrigerant, a mixed refrigerant of the HFC-32 and the HFO refrigerant, carbon dioxide, ammonia, propane, or the like can be used.

Examples of the HFO refrigerant include HFO-1234yf and HFO-1234ze.

The same refrigerant or different refrigerants may be used in the primary-side refrigerant circuit 5*a* and the secondary-side refrigerant circuit 10. Preferably, the refrigerant used in the secondary-side refrigerant circuit 10 has at least one of lower global warming potential (GWP), lower ozone depletion potential (ODP), lower flammability, or lower toxicity than the refrigerant used in the primary-side refrigerant circuit 5*a*. The flammability can be compared in accordance with classifications related to ASHRAE 34 flammability, for example. The toxicity can be compared, for example, in accordance with classifications related to ASHRAE 34 safety grade. In particular, when an overall content volume of the secondary-side refrigerant circuit 10 is larger than an overall content volume of the primary-side refrigerant circuit 5*a*, by using the refrigerant lower than the refrigerant in the primary-side refrigerant circuit 5*a* in at least one of the global warming potential (GWP), the ozone depletion potential (ODP), the flammability, or the toxicity in the secondary-side refrigerant circuit 10, adverse effects when a leak occurs can be reduced.

(13-9) Others

Note that the electric component may drive the compressor.

The control unit may be included in the cascade unit, or may be included in a unit such as a heat source unit other than the cascade unit in the refrigeration cycle apparatus.

The second circuit may include a decompression mechanism capable of decompressing the refrigerant that has passed through the cascade heat exchanger. The refrigerant flowing between the cascade heat exchanger and the decompression mechanism may flow to the first cooling portion, and the refrigerant decompressed by the decompression mechanism may flow to the second cooling portion.

The second circuit may include a first decompression mechanism capable of decompressing the refrigerant that has passed through the cascade heat exchanger, and may include a refrigerant flow path branched from a branch point between the cascade heat exchanger and the first decompression mechanism and provided with a second decompression mechanism. In this case, the refrigerant flowing between the cascade heat exchanger and the branch point may flow to the first cooling portion, and the refrigerant decompressed by the second decompression mechanism in the refrigerant flow path may flow to the second cooling portion.

It is preferable that the electric component casing is not provided with an opening through which an air flow passes.

When the first electric part can be cooled by exhaust heat from the exhaust heat opening, an electric component fan is not required to be provided in the electric component casing.

Note that a first refrigerant may flow through the first circuit, and a second refrigerant different from the first refrigerant may flow through the second circuit.

Supplementary Note

Although the embodiments of the present disclosure have been described above, it will be understood that various changes in form and details can be made without departing from the gist and scope of the present disclosure described in the claims.

REFERENCE SIGNS LIST

1: refrigeration cycle apparatus
2: cascade unit
2*x*: cascade casing
3*a*: first utilization unit
3*b*: second utilization unit
3*c*: third utilization unit
5: primary-side unit
5*a*: primary-side refrigerant circuit (first circuit)
5*x*: primary-side casing (first casing)
10: secondary-side refrigerant circuit (second circuit)
11*a*: first cooling portion (cooling portion)
11*b*: second cooling portion (cooling portion)
12: cascade circuit
13*a*, 13*b*, 13*c*: utilization circuit
17: first electric component cooling flow path
17*a*: first electric component expansion valve
18: second electric component cooling flow path
18*a*: second electric component expansion valve (decompression mechanism)
20: cascade-side control unit (control unit)
21: secondary-side compressor (compressor)
21*a*: compressor motor
22: secondary-side switching mechanism
22*a*: first switching valve
22*b*: second switching valve
22*x*: discharge-side connection portion
22*y*: suction-side connection portion
23: suction flow path
24: discharge flow path
25: third pipe
26: fourth pipe
27: fifth pipe
28: first pipe
29: second pipe
30: secondary-side accumulator
34: oil separator
35: cascade heat exchanger
35*a*: secondary-side flow path
35*b*: primary-side flow path
36: cascade expansion valve
37: secondary-side suction pressure sensor
38: secondary-side discharge pressure sensor
39: secondary-side discharge temperature sensor
45: secondary-side receiver
46: bypass circuit
46*a*: bypass expansion valve
47: secondary-side subcooling heat exchanger
48: secondary-side subcooling circuit
48*a*: secondary-side subcooling expansion valve
50*a-c*: utilization-side control unit
51*a-c*: utilization-side expansion valve
52*a-c*: utilization-side heat exchanger (second heat exchanger)
53*a-c*: indoor fan
58*a*, 58*b*, 58*c*: liquid-side temperature sensor
60*a*, 60*b*, 60*c*: branch unit control unit
66*a*, 66*b*, 66*c*: first control valve
67*a*, 67*b*, 67*c*: second control valve
68*a*, 68*b*, 68*c*: check valve
69*a*, 69*b*, 69*c*: bypass pipe
70: primary-side control unit
71: primary-side compressor (first compressor)
72: primary-side switching mechanism
74: primary-side heat exchanger (first heat exchanger)
76: primary-side first expansion valve
77: outdoor air temperature sensor
78: primary-side discharge pressure sensor
79: primary-side suction pressure sensor
80: control unit
81: primary-side suction temperature sensor
82: primary-side heat exchange temperature sensor
83: secondary-side cascade temperature sensor
84: receiver outlet temperature sensor
85: bypass circuit temperature sensor
86: subcooling outlet temperature sensor
87: subcooling circuit temperature sensor
88: secondary-side suction temperature sensor
90: electric component casing
90*w*: exhaust opening (exhaust heat opening)
90*y*: front surface opening
90*z*: top surface opening (exhaust heat opening)
91: first electric component (inverter part)
92: second electric component (first electric part)
93: third electric component (first electric part)

94: electric component attachment plate
94*a*: ventilation opening
97: electric component fan
98: heat sink
102: primary-side second expansion valve
103: primary-side subcooling heat exchanger
104: primary-side subcooling circuit
104*a*: primary-side subcooling expansion valve
105: primary-side accumulator
111: primary-side first connection pipe
112: primary-side second connection pipe
113: first refrigerant pipe
114: second refrigerant pipe
120*w*: exhaust opening
120*x*: connection opening
120*y*: front surface opening
120*z*: top surface opening

CITATION LIST

Patent Literature

Patent Literature 1: JP 2020-180709 A

The invention claimed is:

1. A refrigeration cycle apparatus comprising
a first circuit in which a heat medium conveying heat flows and that includes a first heat exchanger that exchanges heat between a heat source and the heat medium;
a second circuit in which a refrigerant flows and that includes a compressor and a second heat exchanger that exchanges heat with indoor air;
a cascade heat exchanger that exchanges heat between the heat medium flowing in the first circuit and the refrigerant flowing in the second circuit; and
a cascade unit comprising:
the compressor;
the cascade heat exchanger;
an electric component;
a cooling portion that cools the electric component by the refrigerant flowing through the second circuit; and
a cascade casing that accommodates the compressor, the electric component, and the cooling portion,
wherein the refrigerant is a refrigerant including a carbon dioxide refrigerant, and
the refrigeration cycle apparatus includes a controller that controls a state of the refrigerant flowing through the cooling portion to be equal to or less than a critical pressure or equal to or less than a critical temperature.

2. The refrigeration cycle apparatus according to claim 1, wherein
the electric component includes an inverter part and a first electric part, and
the second circuit includes a first cooling portion that cools the inverter part by the refrigerant, and a second cooling portion that cools the first electric part by the refrigerant having a temperature lower than a temperature of the first cooling portion.

3. The refrigeration cycle apparatus according to claim 2, wherein
the electric component includes an electric component casing that accommodates the inverter part and the first electric part, and
the cascade unit does not include a fan that generates an air flow.

4. The refrigeration cycle apparatus according to claim 3, wherein
further comprising a first casing wherein
the compressor of the second circuit is a second compressor,
the first circuit includes a first compressor,
the first heat exchanger exchanges heat with outdoor air, and
the first casing accommodates the first compressor and the first heat exchanger, wherein
the first casing is different from the cascade casing.

5. The refrigeration cycle apparatus cascade-unit-according to claim 2,
further comprising a first casing wherein
the compressor of the second circuit is a second compressor,
the first circuit includes a first compressor,
the first heat exchanger exchanges heat with outdoor air, and
the first casing accommodates the first compressor and the first heat exchanger, wherein
the first casing is different from the cascade casing.

6. The refrigeration cycle apparatus according to claim 1, wherein
the electric component includes an inverter part, a first electric part, and an electric component casing that accommodates the inverter part and the first electric part,
the cooling portion cools the inverter part, and
the electric component casing has an exhaust heat opening.

7. The refrigeration cycle apparatus according to claim 6, further comprising
an electric component fan that generates an air flow from inside of the electric component casing toward the exhaust heat opening, wherein
the air flow generated by the electric component fan cools the first electric part.

8. The refrigeration cycle apparatus according to claim 7, wherein
further comprising a first casing wherein
the compressor of the second circuit is a second compressor,
the first circuit includes a first compressor,
the first heat exchanger exchanges heat with outdoor air, and
the first casing accommodates the first compressor and the first heat exchanger, wherein
the first casino is different from the cascade casing.

9. The refrigeration cycle apparatus according to claim 6, wherein
further comprising a first casing wherein
the compressor of the second circuit is a second compressor,
the first circuit includes a first compressor,
the first heat exchanger exchanges heat with outdoor air, and
the first casing accommodates the first compressor and the first heat exchanger, wherein
the first casing is different from the cascade casing.

10. The refrigeration cycle apparatus cascade-unit-according to claim 1,
further comprising a first casing wherein
the compressor of the second circuit is a second compressor,
the first circuit includes a first compressor,
the first heat exchanger exchanges heat with outdoor air, and the first casing accommodates the first compressor and the first heat exchanger, wherein the first casing is different from the cascade casing.

* * * * *